US009493280B2

(12) United States Patent
Wilkinson et al.

(10) Patent No.: US 9,493,280 B2
(45) Date of Patent: Nov. 15, 2016

(54) POURABLE SPOUT WITH CHILD PROOF MECHANISM

(71) Applicant: Minerva Manufacturing, LLC, San Marcos, TX (US)

(72) Inventors: William R. Wilkinson, San Marcos, TX (US); Zachary A. Wilkinson, Kyle, TX (US)

( * ) Notice: Subject to any disclaimer, the term of this patent is extended or adjusted under 35 U.S.C. 154(b) by 47 days.

(21) Appl. No.: 14/713,682

(22) Filed: May 15, 2015

(65) Prior Publication Data

US 2015/0368005 A1 Dec. 24, 2015

Related U.S. Application Data

(60) Provisional application No. 61/994,361, filed on May 16, 2014, provisional application No. 62/039,245, filed on Aug. 19, 2014.

(51) Int. Cl.

| | |
|---|---|
| ***B67B 1/00*** | (2006.01) |
| ***B65D 47/24*** | (2006.01) |
| ***B65D 25/48*** | (2006.01) |

(52) U.S. Cl.

CPC ..... *B65D 47/248* (2013.01); *B65D 25/48* (2013.01)

(58) Field of Classification Search

CPC .. B65D 47/248; B65D 47/249; B65D 25/48; B65D 25/50

USPC ..... 222/153.14, 567, 465.1, 166, 484

See application file for complete search history.

(56) References Cited

U.S. PATENT DOCUMENTS

| | | | | |
|---|---|---|---|---|
| D303,634 | S | 9/1989 | Vachon | |
| 4,958,668 | A | 9/1990 | Vachon | |
| 5,076,333 | A | 12/1991 | Law | |
| 6,155,464 | A | 12/2000 | Vachon | |
| 7,128,108 | B2 | 10/2006 | Nielsen | |
| 8,403,185 | B2 | 3/2013 | Vachon | |
| 8,561,858 | B2 | 10/2013 | Vachon | |
| 8,800,826 | B2 * | 8/2014 | Forbis | B67D 7/04 222/153.14 |
| 2012/0118431 | A1 * | 5/2012 | Dickie | B65D 25/48 141/311 R |
| 2013/0193165 | A1 | 8/2013 | Vachon | |
| 2013/0334254 | A1 | 12/2013 | Rose | |
| 2014/0076938 | A1 * | 3/2014 | Bonner | B67D 7/005 222/484 |

* cited by examiner

*Primary Examiner* — Lien Ngo

(57) ABSTRACT

In some embodiments, a system and/or method may include a pouring spout assembly for a container. In some embodiments, the pouring spout assembly may include a first conduit, a second conduit, a third conduit, a fourth conduit, a handle, and a spout lock. The second conduit may be positionable, during use, in a distal end of the first conduit. The third conduit may be positionable, during use, in a proximal end of the first conduit. The fourth conduit may be coupled to the second conduit. When the second conduit is in a first position liquids and gases may be inhibited from being conveyed through the pouring spout assembly. When the second conduit is in a second position gases are allowed to convey through the pouring spout assembly. When the second conduit is in a third position liquids are allowed to convey through the pouring spout assembly.

20 Claims, 22 Drawing Sheets

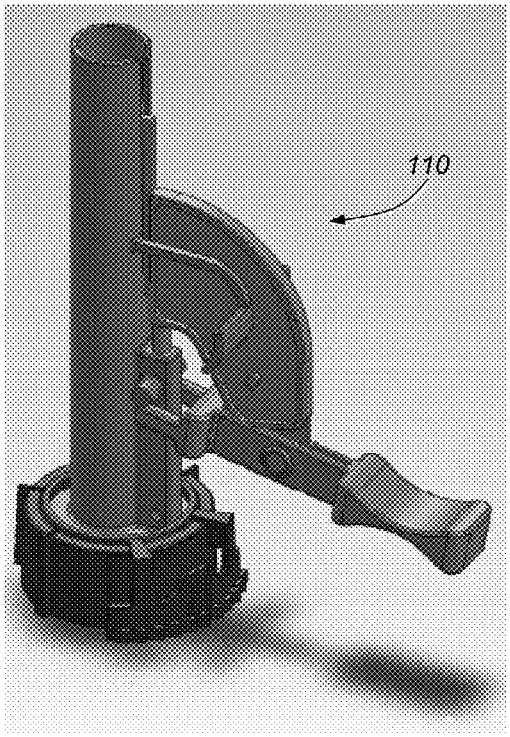
FIG. 12
FIG. 13
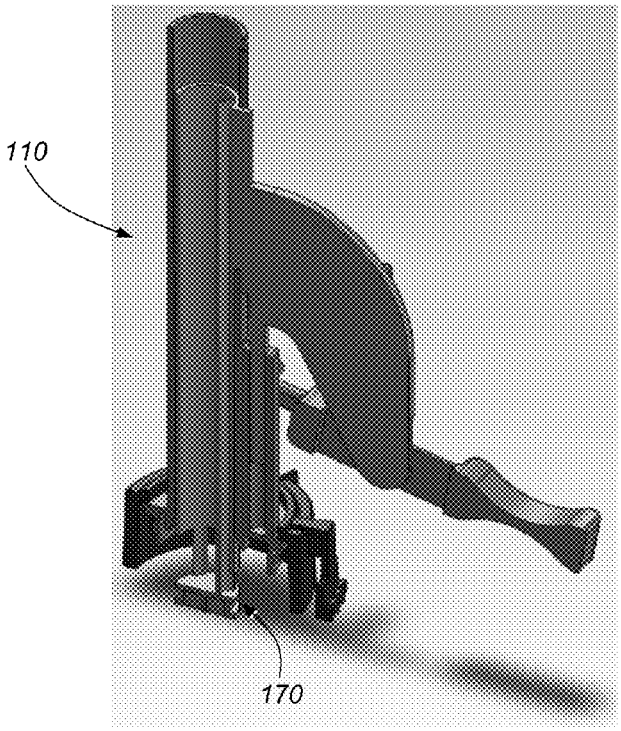

POURABLE SPOUT WITH CHILD PROOF MECHANISM

PRIORITY CLAIM

This application claims priority to U.S. Provisional Patent Application No. 61/994,361 entitled "POURABLE SPOUT WITH CHILD PROOF MECHANISM" filed on May 16, 2014, and U.S. Provisional Patent Application No. 62/039,245 entitled "POURABLE SPOUT WITH CHILD PROOF MECHANISM" filed on Aug. 19, 2014, all of which are incorporated by reference herein.

BACKGROUND OF THE INVENTION

1. Field of the Invention

The present disclosure generally relates to pouring spouts. More particularly, the disclosure generally relates to a method and system for pouring liquid through a spout assembly couplable to a container.

2. Description of the Relevant Art

When transferring fluids from a container, typically it is necessary to attach a pouring spout to the container to prevent unwanted spillage. Such transfer methods are commonly used to deliver fluids (e.g., motor oil, antifreeze, transmission fluid, and gasoline) to a vehicle. FIG. 1 depicts a perspective view of a representation of an embodiment of a fluids (e.g., gas) container 100.

As of Jan. 10, 2009, all portable fuel containers are required to conform to two new regulations. Firstly fuel containers must meet new federal Mobile Source Air Toxic regulations, based on the California Air Resources Board's regulations. Secondly fuel containers must meet the requirements of the Children's Gasoline Burn Prevention Act. These new regulations do not apply to OSHA-approved metal safety containers, but rather to the common red plastic, portable gas cans. The regulations apply only to newly manufactured gasoline cans, and there is no requirement on the part of users to discard their existing cans or to upgrade, although the EPA provides informational resources for implementing community Gas Can Exchange Programs.

Currently available pouring spouts, which attempt to meet the new regulations, are many times difficult to use. The difficulty arises in that they appear to require applying pressure to a portion of the pouring spout using the container into which fuel is being transferred. This can be difficult to apply enough leverage against the portion of the spout and can be dangerous depending upon what type of container the fluids are being transferred to (e.g., is the container stable enough to use for leverage without tipping over or being damaged resulting in a spill).

Thus, there is a need for an improved pouring spout for a container to facilitate the easy and clean transfer of pourable materials from a container which complies with these new regulations.

SUMMARY

In some embodiments, a system and/or method may include a pouring spout assembly for a container. In some embodiments, the pouring spout assembly may include a first conduit, a second conduit, a third conduit, a fourth conduit, a handle, and a spout lock. The second conduit may be positionable, during use, in a distal end of the first conduit. The third conduit may be positionable, during use, in a proximal end of the first conduit. The fourth conduit may be coupled to the second conduit. When the second conduit is in a first position liquids and gases may be inhibited from being conveyed through the pouring spout assembly. When the second conduit is in a second position gases are allowed to convey through the pouring spout assembly. When the second conduit is in a third position liquids are allowed to convey through the pouring spout assembly.

In some embodiments, the spout lock inhibits, during use, movement of the second conduit from the first position to the second position when the spout lock is engaged. The spout lock may include a first elongated member. The first elongated member may be coupled to the first conduit. When a first portion of the first elongated member engages, during use, a raised portion of a first projection coupled to the handle the spout lock is engaged. When the spout lock is engaged, an extension of the handle engages a second portion of the first elongated member inhibiting movement of the second conduit from the first position to the second position.

BRIEF DESCRIPTION OF THE DRAWINGS

Advantages of the present invention may become apparent to those skilled in the art with the benefit of the following detailed description of the preferred embodiments and upon reference to the accompanying drawings.

FIG. 12 depicts a perspective view of a representation of an embodiment of the pouring spout assembly depicted in FIG. 3 in an open position.

FIG. 13 depicts a cross sectional view of a representation of an embodiment of the pouring spout assembly depicted in FIG. 12.

Figure 1:
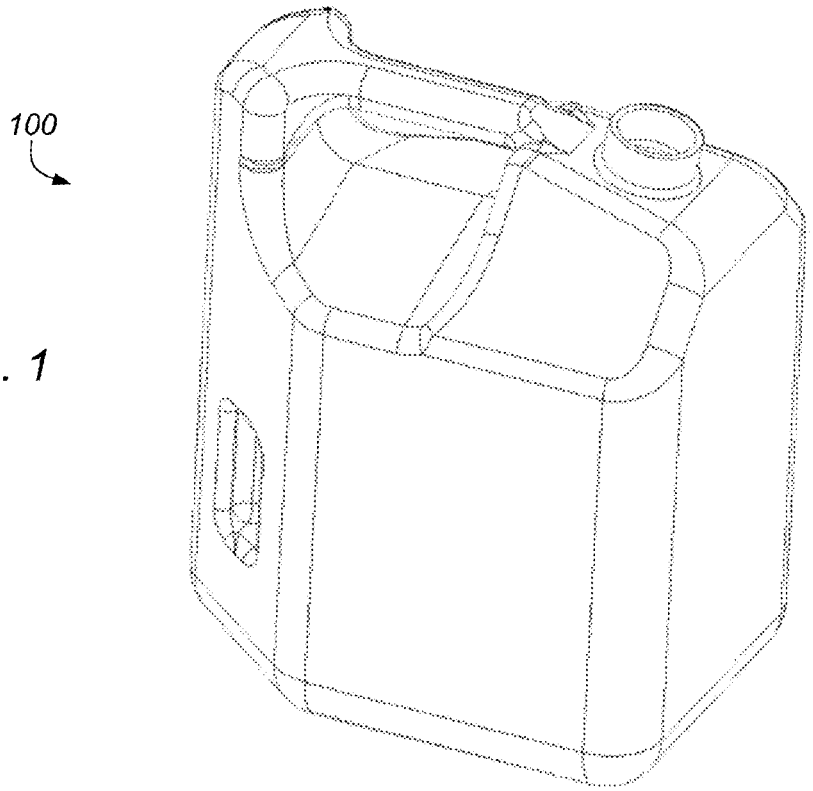
FIG. 1 depicts a perspective view of a representation of an embodiment of a fluids (e.g., gas) container.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. For example, a "third die electrically connected to the module substrate" does not preclude scenarios in which a "fourth die electrically connected to the module substrate" is connected prior to the third die, unless otherwise specified. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task (e.g., a set of electrical conductors may be configured to electrically connect a module to another module, even when the two modules are not connected). In some contexts, "configured to" may be a broad recitation of structure generally meaning "having circuitry that" performs the task or tasks during operation. As such, the component can be configured to perform the task even when the component is not currently on. In general, the circuitry that forms the structure corresponding to "configured to" may include hardware circuits.

Various components may be described as performing a task or tasks, for convenience in the description. Such descriptions should be interpreted as including the phrase "configured to." Reciting a component that is configured to perform one or more tasks is expressly intended not to invoke 35 U.S.C. §112 paragraph (f), interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

It is to be understood the present invention is not limited to particular devices or biological systems, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DETAILED DESCRIPTION

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members.

The term "directly" as used herein generally refers to one structure in physical contact with another structure, or, when used in reference to a procedure, means that one process effects another process or structure without the involvement of an intermediate step or component.

The term "elastically deformable" as used herein generally refers to the tendency of solid materials to return to their original shape after being deformed.

Figure 2:
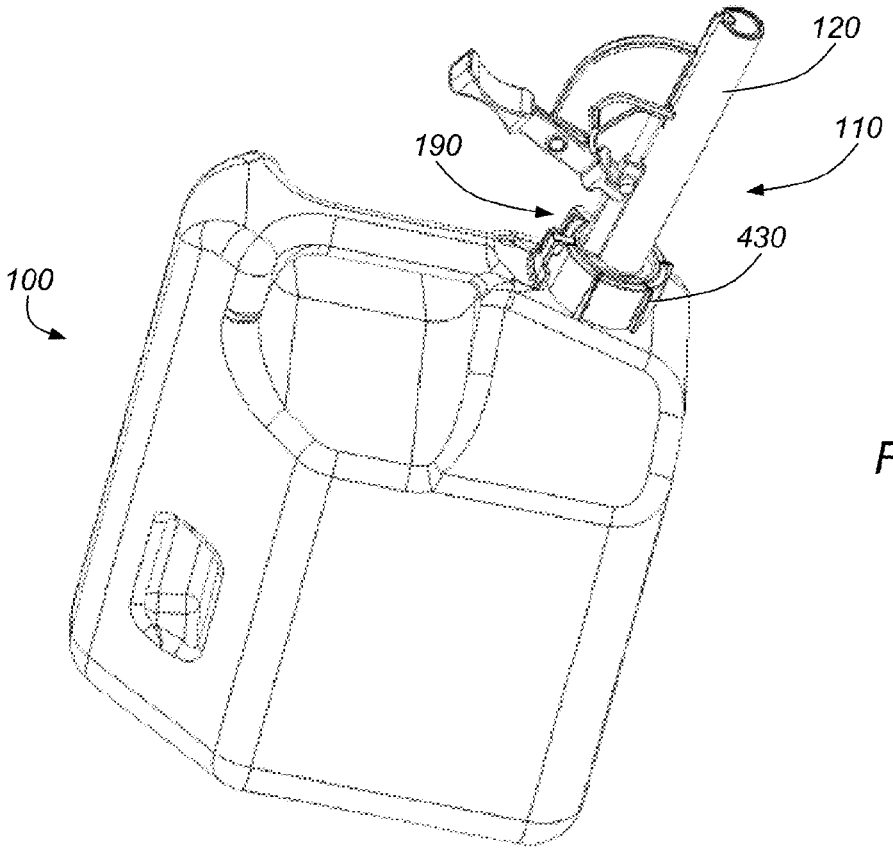
FIG. 2 depicts a perspective view of a representation of an embodiment of a pouring spout assembly coupled to a fluids (e.g., gas) container.
Figure 8:
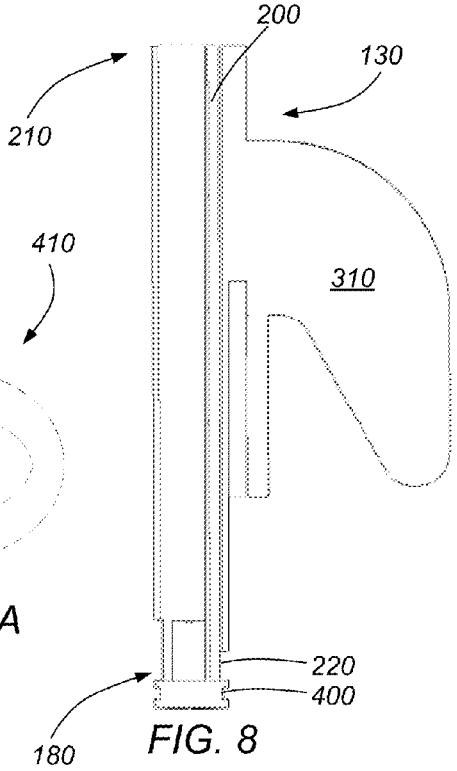
FIG. 8 depicts a cross sectional view of a representation of an embodiment of a second conduit of the pouring spout assembly depicted in FIG. 3.
Figure 9:
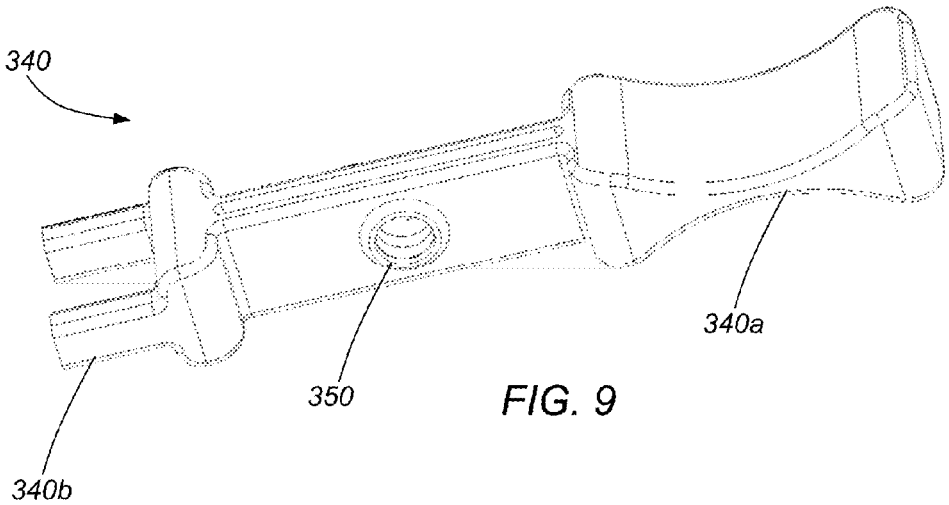
FIG. 9 depicts a perspective view of a representation of an embodiment of a lever of the pouring spout assembly depicted in FIG. 3.

In some embodiments, a system and/or method may include a pouring spout assembly for a container. FIG. 2 depicts a perspective view of a representation of an embodiment of a pouring spout assembly 110 coupled to a fluids (e.g., gas) container 100. In some embodiments, the pouring spout assembly may include a first conduit 120, a second conduit 130, a handle 140, and a spout lock 150 (e.g., depicted in FIGS. 3-4). FIGS. 3-24 depict representations of embodiments of a pouring spout assembly 110. The second conduit 130 may be positionable, during use, in the first conduit 120. The second conduit may move, during use, from a first position 160 (e.g., depicted in FIG. 4) to a second position 170 (e.g., depicted in FIG. 13). When the second conduit is in the first position fluids may be inhibited from being conveyed through a proximal end 180 of the second conduit 130 (e.g., depicted in FIG. 8). During use when a proximal end 190 of the pouring spout 110 is coupled to a fluids container 100 (e.g., depicted in FIG. 2), the pouring spout inhibits fluids from exiting the can through the pouring spout when the second conduit is in the first position. When the second conduit is in the second position fluids may be allowed to convey through the proximal end of the second conduit. The handle may be coupled to the first conduit and the second conduit. The handle may convey, during use, the second conduit from the first position to the second position when pressure is applied to the handle. In some embodiments, the second conduit may be biased towards the first position. The spout lock may inhibit, during use, movement of the second conduit from the first position to the second position when the spout lock is engaged.

In some embodiments, a pouring spout assembly 110 may include a third conduit 200 (e.g., depicted in FIGS. 4, 7, 16, and 20). The third conduit may be positioned in and coupled to the second conduit 130. In some embodiments, the third conduit extends from at least substantially adjacent the proximal end 180 of the second conduit 130 to at least substantially adjacent a distal end 210 of the second conduit 130 (e.g., depicted in FIGS. 8 and 20). The third conduit may allow, during use, air to move past the proximal end 180 of the second conduit 130. Allowing air to move past the proximal end of the second conduit may allow fluids in the container to flow more easily out of the spout assembly. The third conduit may be located on a same side as the handle such that when a user pours liquids from a container the third conduit should be located on an opposing side from exiting fluids such that fluids are inhibited from exiting through the third conduit (allowing air to flow through the third conduit into the container). An opening 220 (e.g., depicted in FIGS. 7-8 and 20) into the third conduit 200 at the proximal end may be oriented away from flowing liquids further inhibiting the entrance of flowing liquids into the third conduit. The opening in the proximal end of the third conduit may be positioned beyond a flow pattern of exiting fluids. When the proximal end becomes submerged in the fluid of the receiving container (due to the container being full), the air supply through the third conduit is shut off, halting the flow of liquid into the receiving container (an "auto-shutoff" feature).

Figure 4A:
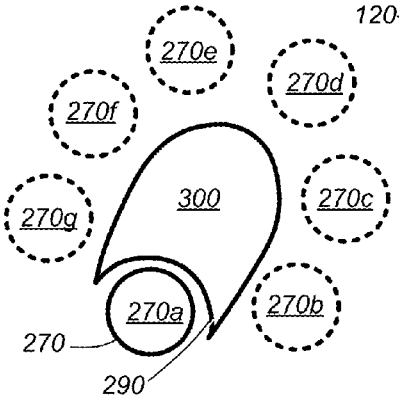
FIG. 4A depicts an enlarged view of a representation of an embodiment of a portion of a spout lock.
Figure 4:
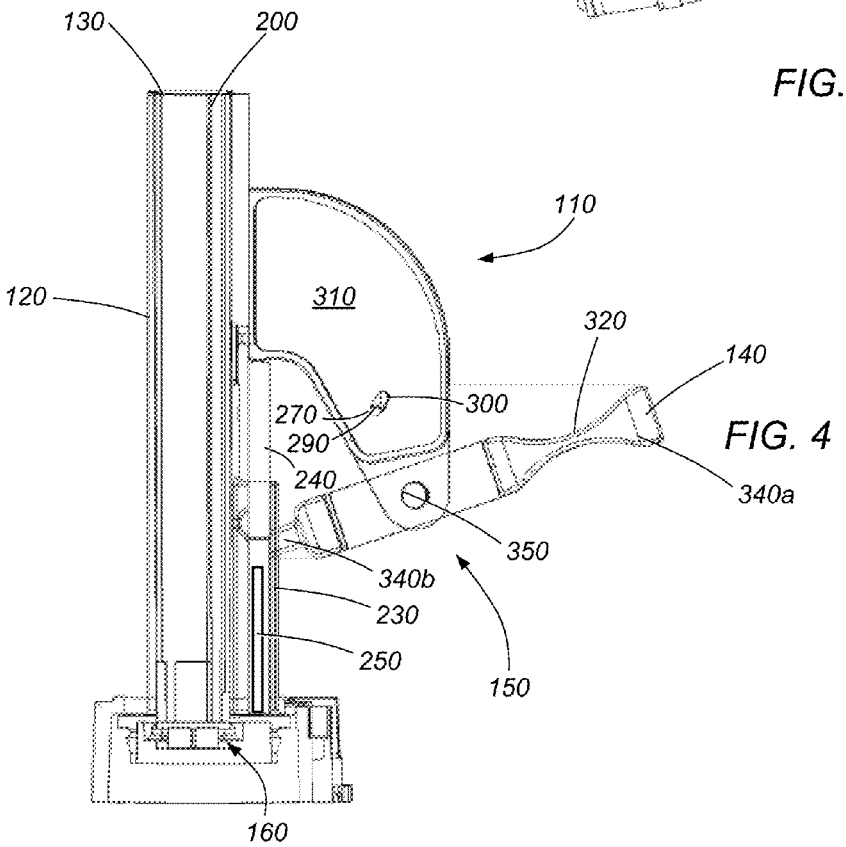
FIG. 4 depicts a cross sectional view of a representation of an embodiment of the pouring spout assembly depicted in FIG. 3.
Figure 5:
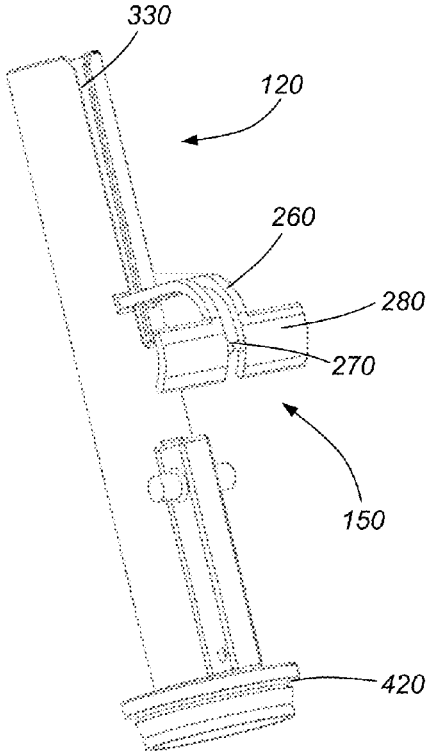
FIG. 5 depicts a perspective view of a representation of an embodiment of a first conduit of the pouring spout assembly depicted in FIG. 3.
Figure 6:
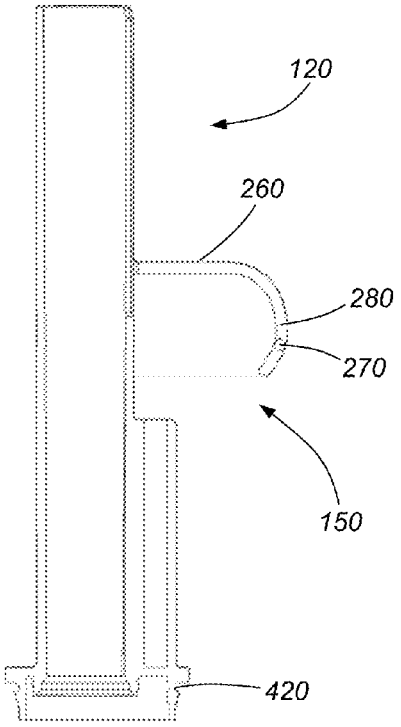
FIG. 6 depicts a cross sectional view of a representation of an embodiment of a first conduit of the pouring spout assembly depicted in FIG. 3.

In some embodiments, a pouring spout assembly 110 may include a fourth conduit 230, a second elongated member 240, and an elastically deformable member 250 (e.g., depicted in FIG. 4). The fourth conduit may be coupled to the first conduit. The fourth conduit may be directly attached to the first conduit (e.g., depicted in FIG. 6). In some embodiments, the second elongated member may be coupled to the handle (e.g., directly attached) and the second elongated member. At least a portion of the second elongated member may be positionable, during use, in the fourth conduit. The elastically deformable member may be positioned in the fourth conduit. The elastically deformable member may apply, during use, a force against the second elongated member. The elastically deformable member may apply, during use, a counterforce against the second elongated member in response to a force is applied to the elastically deformable member by, for example, the second elongated member. In some embodiments, an elastically deformable member may include a spring. Springs of varying resistance may be used as is necessary.

In some embodiments, the spout lock 150 may include a first elongated member 260 and a first projection 270 (e.g., depicted in FIGS. 5-6 and 17-18). The first elongated member may be coupled to the first conduit. The first projection may be coupled to the first elongated member. In some embodiments, the spout lock may include an engagement point 280 (e.g., depicted in FIGS. 5-6 and 17-18). The engagement point may be coupled (e.g., directly attached) to the first elongated member and the first projection. When the first projection engages, during use, an indentation 290 of a second projection 300 the spout lock is engaged 270*a* (e.g., depicted in FIGS. 4-4A). The second projection may be coupled to the handle. In some embodiments, when sufficient force is applied to the first projection (e.g., using the engagement point(s)) the first projection disengages from the indentation unlocking the spout lock and allowing movement of the second conduit from the first position to the second position. The force may be applied by a user (e.g., using their fingers) to unlock the spout lock. In some embodiments, force directed towards the first conduit (e.g., as in the embodiment depicted in FIG. 3) may be applied to the engagement points to unlock the spout lock. In some embodiments, force directed away from the first conduit (e.g., as in the embodiment depicted in FIG. 15) may be applied to the engagement points to unlock the spout lock.

When the first projection disengages the first projection moves to an unengaged position 270*b* adjacent the exterior perimeter of the second projection 300 (e.g., depicted in FIG. 4A). In some embodiments, after disengagement of the spout lock and as pressure is applied to the handle the first projection moves from the unengaged position 270*b* around the exterior perimeter of the second projection 270*c-g* until the handle is released and the first projection engages 270*a* the indentation locking the spout lock. In some embodiments, the engagement point may work in combination with portions of the handle to form the spout lock. In some embodiments, the handle may include a coupling portion 310 and a grasping portion 320 (e.g., depicted in FIGS. 4 and 19-20). The second projection 300 may be coupled (e.g., directly attached) to the coupling portion 310. The coupling portion may be coupled to the second conduit through an elongated opening 330 (e.g., depicted in FIGS. 5 and 17). The coupling portion may travel along the elongated opening as the second conduit moves relative to the first conduit.

In some embodiments, the grasping portion may be coupled (e.g., directly attached e.g., depicted in FIGS. 19-20) to the coupling portion. The grasping portion may be formed as a single unit in combination with the coupling portion (e.g., depicted in FIGS. 15-16 and 19-20). In some embodiments, the grasping portion may include a lever 340 (e.g., depicted in FIGS. 3-4 and 9). The lever may be pivotally 350 coupled to the coupling portion (e.g. pivotally coupled in substantially a center of the lever). A first end

Figure 3:
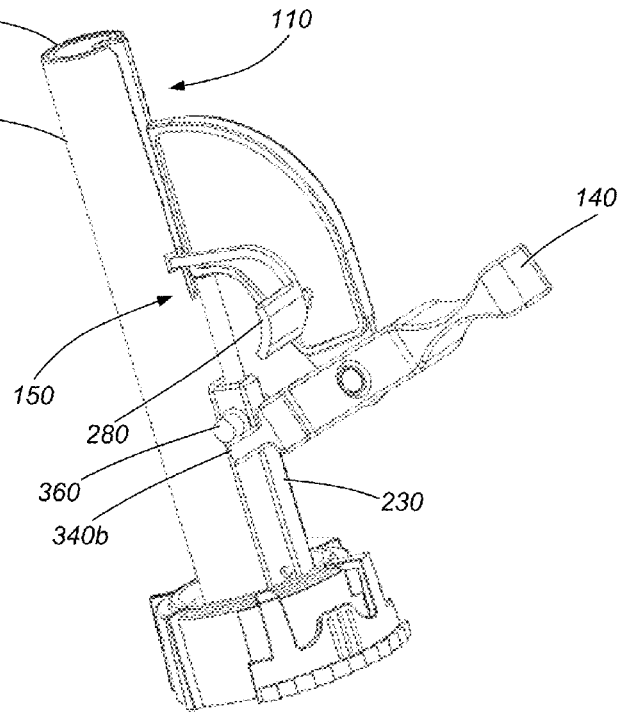
FIG. 3 depicts a perspective view of a representation of an embodiment of a pouring spout assembly in a closed position.

340*a* of the lever may allow a user to apply pressure against the lever such that the coupling portion/second conduit move relative to the first conduit due to a second end 340*b* of the lever being inhibited (e.g., by projections 360, as depicted in FIG. 3) from rotating in at least a first direction. In some embodiments, the grasping portion may be immovably coupled to the coupling portion such that as force is applied to the grasping portion the force is directly transferred to the coupling portion and the second conduit and the second elongated member compressing the elastically deformable member into the fourth conduit.

Figure 14:
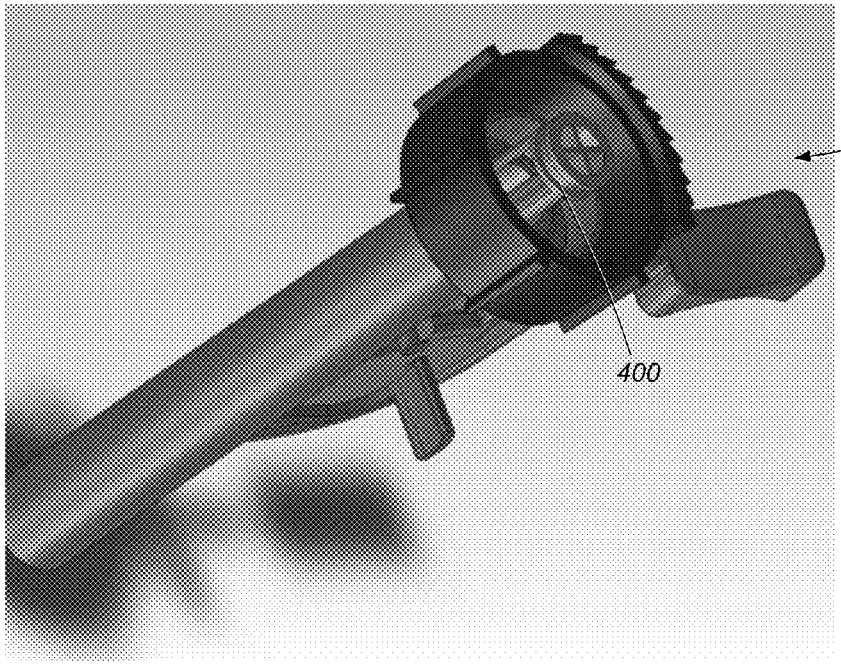
FIG. 14 depicts a perspective view of a representation of an embodiment of an underside of the pouring spout assembly depicted in FIG. 12.
Figure 15:
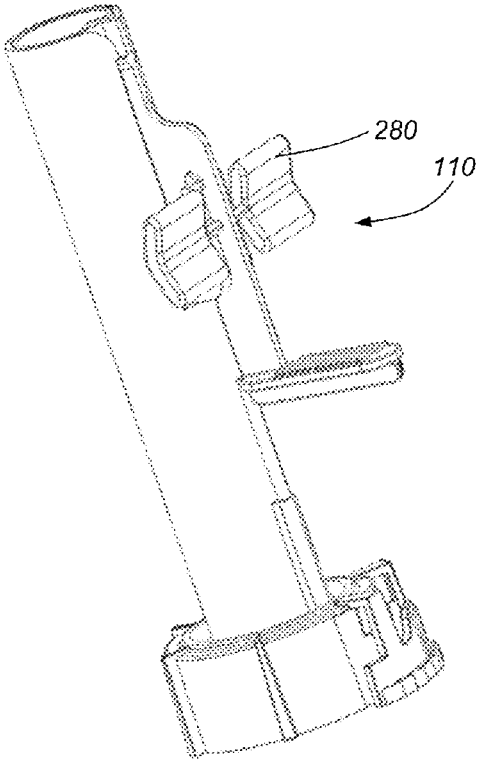
FIG. 15 depicts a perspective view of a representation of an embodiment of a pouring spout assembly in a closed position.

As stated, in some embodiments, as the second conduit moves from a first position to a second position (e.g., depicted in FIGS. 12-14) fluids are allowed to flow through a proximal end of the pouring spout assembly and specifically through the proximal end of the second conduit (e.g., depicted in FIG. 14). In some embodiments, fluids may flow through one or more openings in the proximal end of the second conduit (e.g., depicted in FIGS. 13-14). After a desired amount of fluids have been conveyed out of the container, the handle may be disengaged by a user such that the second conduit automatically conveys from the second position to the first position. The second conduit may automatically convey from the second position to the first position as a result of compressed elastically deformable member 250 applying a counteractive force on second elongated member 240 which is transmitted to the second conduit 130. As the second conduit conveys toward the first position the first projection automatically engages (e.g., 270*a* as depicted in FIG. 4A) the indentation locking the spout lock (e.g., finishing the first projection's substantially circular arc around the second projection).

Figure 16:
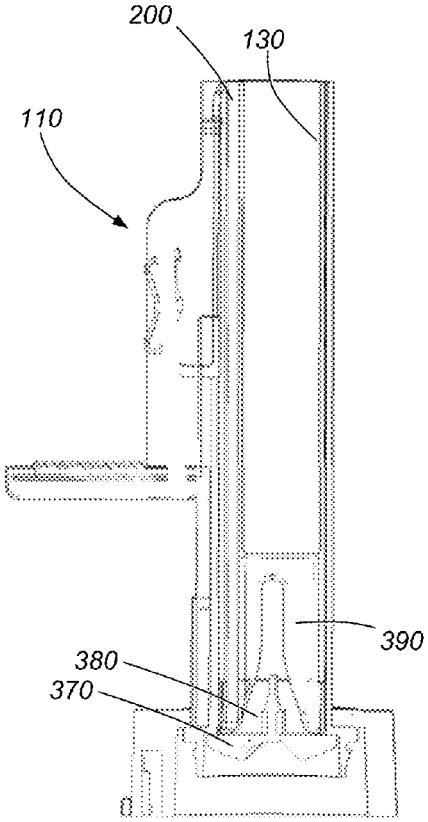
FIG. 16 depicts a cross sectional view of a representation of an embodiment of the pouring spout assembly depicted in FIG. 15.
Figure 17:
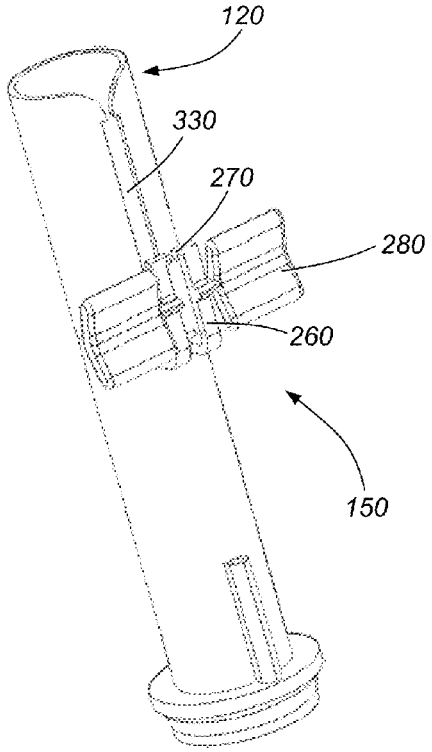
FIG. 17 depicts a perspective view of a representation of an embodiment of a first conduit of the pouring spout assembly depicted in FIG. 15.
Figure 18:
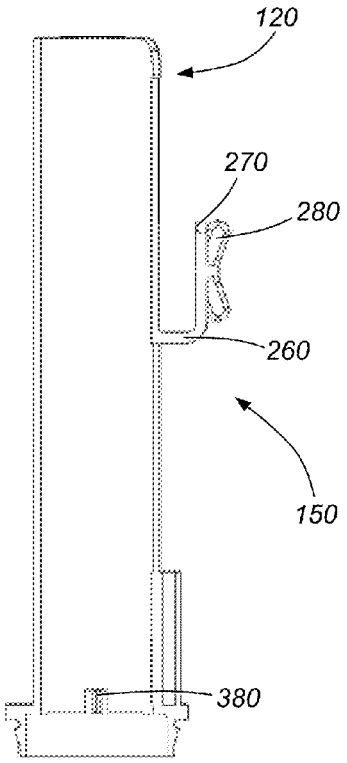
FIG. 18 depicts a cross sectional view of a representation of an embodiment of a first conduit of the pouring spout assembly depicted in FIG. 15.
Figure 19:
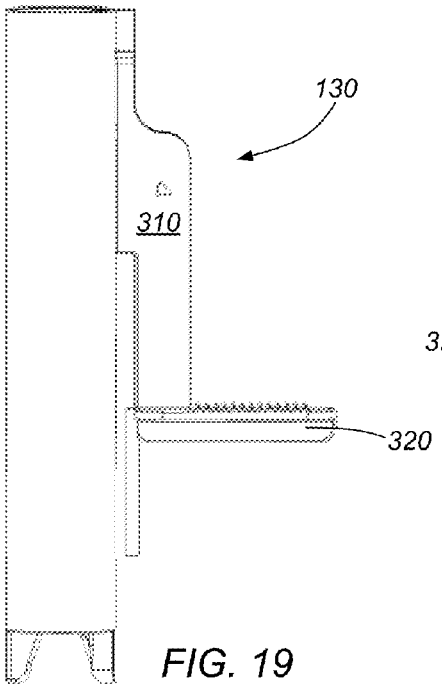
FIG. 19 depicts a side view of a representation of an embodiment of a second conduit of the pouring spout assembly depicted in FIG. 15.
Figure 21:
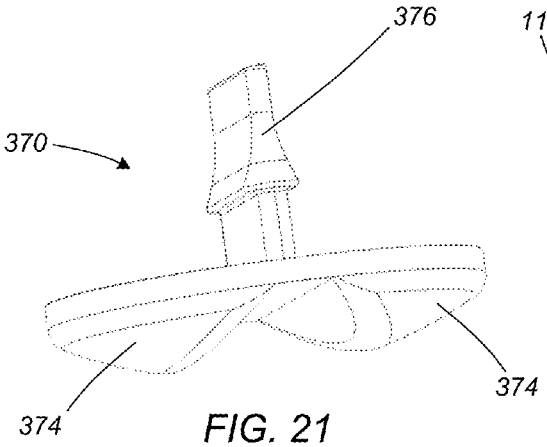
FIG. 21 depicts a perspective view of a representation of an embodiment of an umbrella seal of the pouring spout assembly depicted in FIG. 15.
Figure 22:
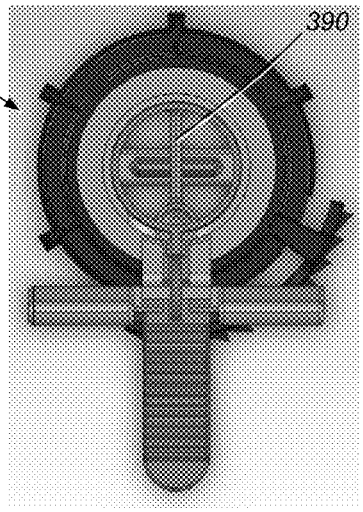
FIG. 22 depicts a top view of a representation of an embodiment of the pouring spout assembly depicted in FIG. 15 in an open position.
Figure 23:
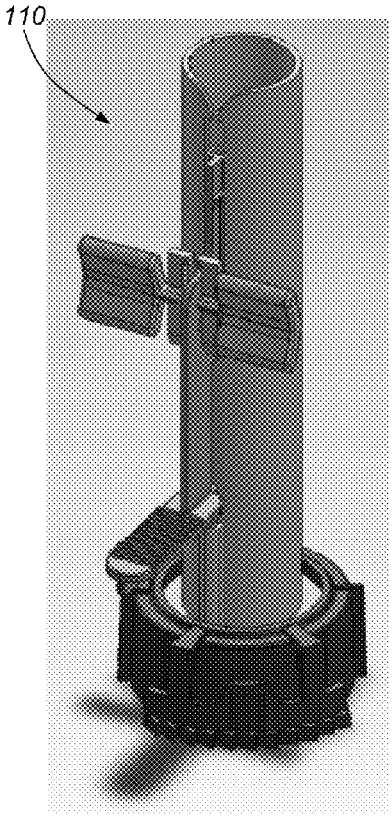
FIG. 23 depicts a perspective view of a representation of an embodiment of the pouring spout assembly depicted in FIG. 15 in an open position.

In some embodiments, a pouring spout assembly 110 may include an elastically deformable seal 370 (e.g., depicted in FIGS. 16 and 21). The elastically deformable seal may be coupled to a proximal portion 380 of the first conduit 120 (e.g., depicted in FIGS. 16, 18, and 24). The elastically deformable seal may inhibit, during use, fluids from being conveyed through the proximal end of the second conduit when the second conduit is in the first position (e.g., depicted in FIG. 16). In some embodiments, the elastically deformable seal may include an umbrella gasket (e.g., depicted in FIG. 21). The elastically deformable seal may be coupled to a proximal portion 380 of the first conduit 120 (e.g., depicted in FIG. 16). A flexible portion 376 of the seal may be pressed through an opening in portion 380.

Figure 20:
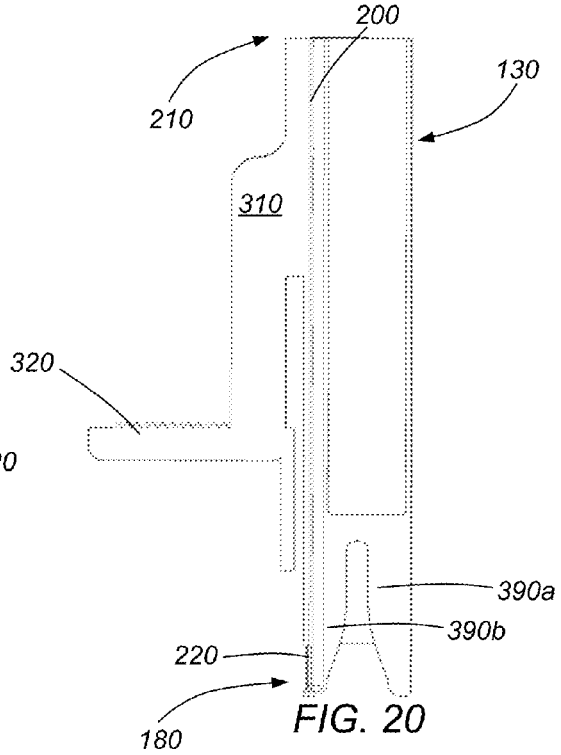
FIG. 20 depicts a cross sectional view of a representation of an embodiment of a second conduit of the pouring spout assembly depicted in FIG. 15.
Figure 24:
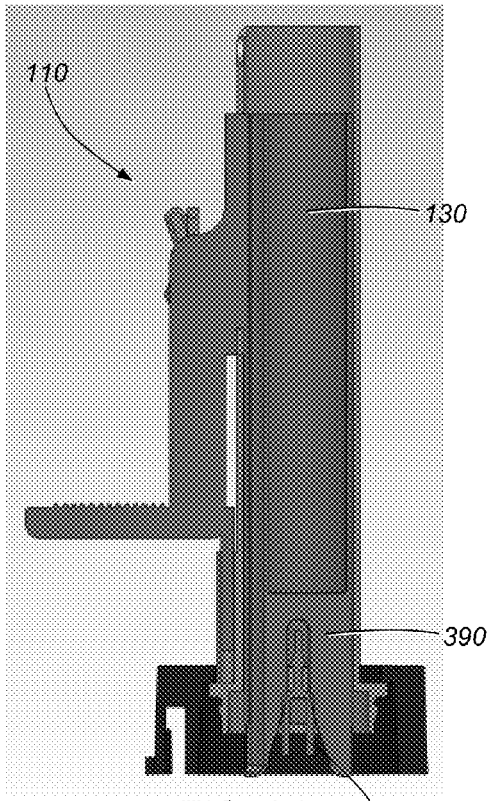
FIG. 24 depicts a cross sectional view of a representation of an embodiment of the pouring spout assembly depicted in FIG. 15 in an open position.

In some embodiments, a pouring spout assembly 110 may include at least one disengaging portion 390 (e.g., depicted in FIGS. 16, 20, and 24). The disengaging portion may be coupled to an interior surface of the second conduit 130. The disengaging portion may move, during use, a portion of the seal 370 from a first closed position (e.g., depicted in FIG. 16) to a second open position (e.g., depicted in FIG. 24) when the second conduit moves from the first position to the second position. The disengaging portion may include two disengaging portions 390*a-b* (e.g., depicted in FIG. 20) which move opposing sides 374 of an umbrella seal 370 down, opening up the proximal end of the second conduit such that fluids may flow through the second conduit (e.g., depicted in FIGS. 21-24). The disengaging portions may be formed as a single entity (e.g., depicted in FIG. 24) and/or coupled. The disengaging portion 390 may be formed as a single relatively thin planar member (e.g., depicted in FIG. 22) such as to inhibit as little as possible the flow of fluids out of the container through the pouring spout assembly 110.

Figure 7:
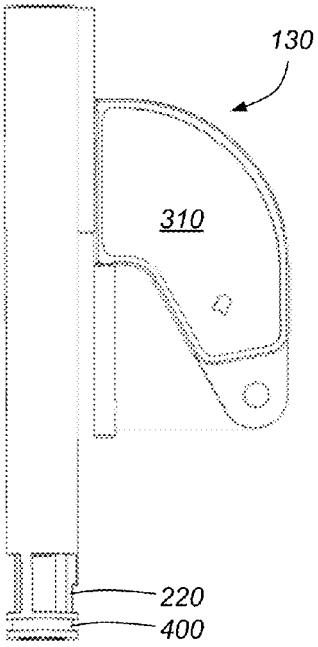
FIG. 7 depicts a perspective view of a representation of an embodiment of a seal.
Figure 7A:
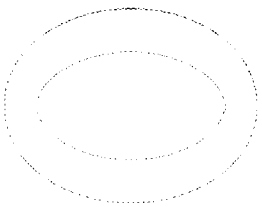
FIG. 7A depicts a perspective view of a representation of an embodiment of a second conduit of the pouring spout assembly depicted in FIG. 3.

In some embodiments, a pouring spout assembly 110 may include a seal 410 (e.g., depicted in FIG. 7A). In some embodiments, the seal may be coupled to the proximal end of the second conduit (e.g., the seal may be positioned in a channel 400 at a proximal end of the second conduit depicted in FIGS. 7-8 and 14). The seal may inhibit, during use, fluids from being conveyed through the proximal end of the second conduit when the second conduit is in the first position. The pouring spout assembly may include additional seals which function to inhibit leaking of fluids from the container. In some embodiments, a seal 410 may be coupled to the proximal end of the first conduit 120 (e.g., the seal may be positioned in a channel 420 at a proximal end of the first conduit 120 depicted in FIGS. 5-6). The seal may function to inhibit fluids from leaking around the proximal end of the first conduit 120 when the pouring spout assembly is coupled to the container (e.g., with the cap). Seals may be elastically deformable. Seals may be pliable. Seals may be formed from materials including such properties which are resistant to solvents and/or caustic fluids such as gasoline (e.g., rubber, silicone based polymers, etc.). Seals may be formed from a fluoroelastomer that gives good service in the gasoline environment. Fluoroelastomers may vary in fluorine content from about 66% to 70%. Materials which are desirable may include the best combination of functional sealing, mechanical hysteresis, and durability.

Requirements for air quality, as dictated by the government, include the ability of a container to withstand at least 26 PSI internal pressure without gasoline vapors escaping the container. Such pressures may build when a container is closed cold and then heated (e.g., from sitting in the sun). In some embodiments, the pouring spout assemblies are such that this internal pressure serves to further seat the valve and increase the seal strength as the pressure rises. In some embodiments, the rising internal pressure may push, for example, seal 370 against a proximal portion of the first conduit 120 increasing the seal strength. In some embodiments, the rising internal pressure may push, for example, seal 410 (e.g., when positioned in channel 400) against a proximal portion of the first conduit 120 increasing the seal strength.

Figure 10:
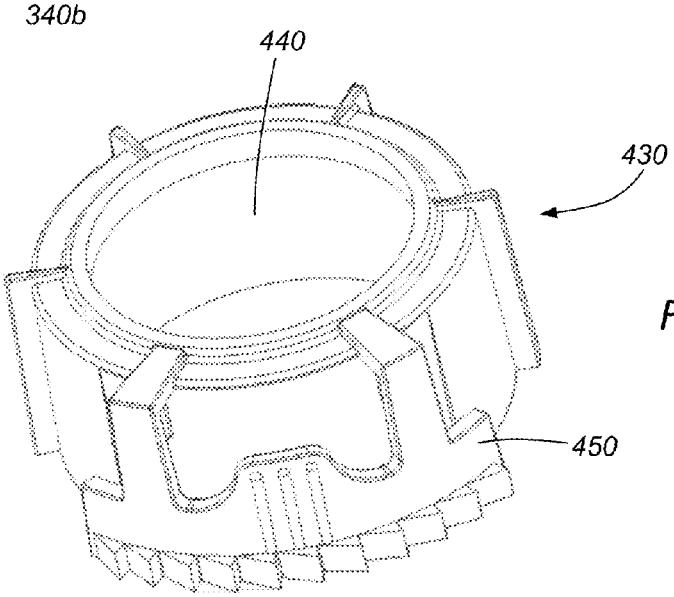
FIG. 10 depicts a perspective view of a representation of an embodiment of a cap of the pouring spout assembly depicted in FIG. 3.
Figure 11:
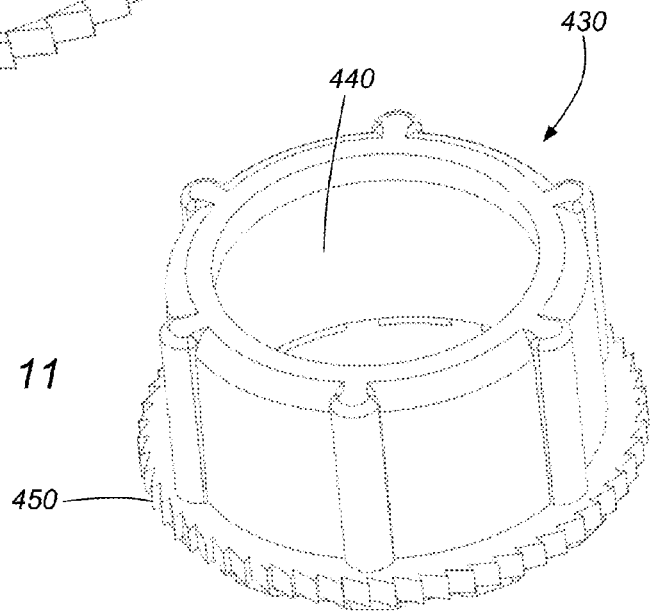
FIG. 11 depicts a perspective view of a representation of an embodiment of a cap of a pouring spout assembly.

In some embodiments, a pouring spout assembly 110 may include a cap 430 (e.g., depicted in FIGS. 10-11). The cap 430 may function to couple the first conduit 120 to the container 100 (e.g., depicted in FIG. 2). When engaged to the container, the cap may inhibit movement of the first conduit relative to the container. The first conduit may be positionable in a cap opening 440 (e.g., depicted in FIGS. 10-11). The proximal end of the first conduit may be dimensioned such that the proximal end does not pass through the cap opening. In some embodiments, the cap may include a cap lock 450 which inhibits, during use, removal of the cap from the container. The cap lock may function to inhibit inadvertent removal of the cap and the spout assembly from the container. The cap lock may function in combination with portions of the container to inhibit removal. Caps may be interchangeable with pouring spout assemblies such that different types of caps may be used to work in combination with different containers including different locking mechanisms. In some embodiments cap locks may include cap locking mechanisms known to one skilled in the art.

In some embodiments, at least portions of the pouring spout assembly may be formed from materials including such properties which are resistant to solvents and/or caustic fluids such as gasoline (e.g., plastics, polymers, etc.). Portions of the pouring spout assembly may be formed from a rigid or semi rigid plastic such as polyolefins (Polyethylene, polypropylene, etc.), nylons, polyester, etc.

Vented Pouring Spout with Double Locking Mechanism

Figure 44:
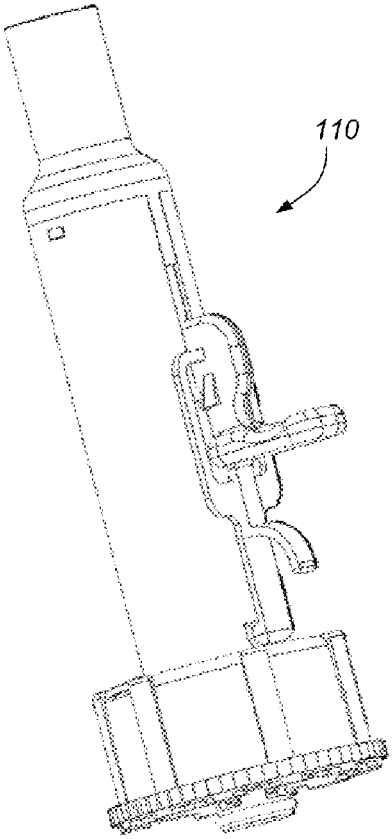
FIG. 44 depicts a perspective view of a representation of an embodiment of the pouring spout assembly depicted in FIG. 25 in a vented position such that gases and liquids are allowed to exit.
Figure 45:
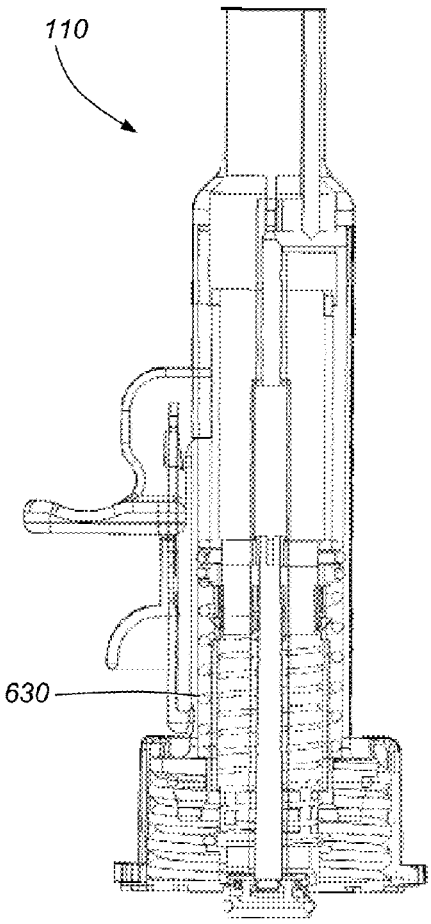
FIG. 45 depicts a cross sectional view of a representation of an embodiment of the pouring spout assembly depicted in FIG. 25 in a vented position such that gases and liquids are allowed to exit.

In some embodiments, a system and/or method may include a pouring spout assembly 110 for a container. In some embodiments, the pouring spout assembly 110 may include a first conduit 500, a second conduit 510, a third conduit 520, a fourth conduit 530, a handle 540, and a spout lock 550. The second conduit 510 may be at least partially positionable, during use, in a distal end 500*a* of the first conduit 500. The third conduit 520 may be positionable, during use, in a proximal end 500*b* of the first conduit 500. The fourth conduit 530 may be coupled to the second conduit 510. When the second conduit 510 is in a first position (e.g., FIGS. 25-26) liquids and gases may be inhibited from being conveyed from the container 100 through the pouring spout assembly 110. When the second conduit 510 is in a second position gases are allowed to convey from the container 100 through the pouring spout assembly 110. When the second conduit 510 is in a third position liquids are allowed to convey from the container 100 through the pouring spout assembly 110. As such, in some embodiments, opening the pouring spout assembly to pour liquids (e.g., gas) may include two steps wherein as the second conduit moves from the first position (e.g., FIGS. 25-26) to the second position (e.g., FIGS. 42-43) gases are vented (especially in the case of pressure build up) and as the second conduit moves from the second position to the third position (e.g., FIGS. 44-45) liquids are allowed to exit through the pouring spout assembly.

Figure 36:
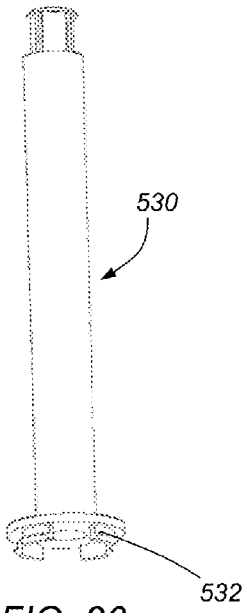
FIG. 36 depicts a perspective view of a representation of an embodiment of a distal portion of a fourth conduit of the pouring spout assembly depicted in FIG. 25.
Figure 37:
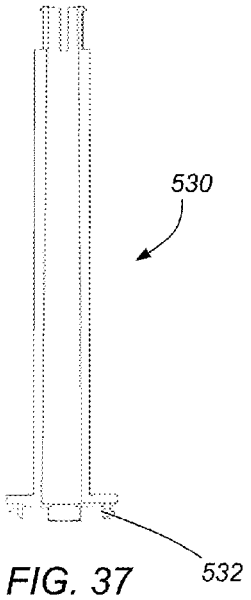
FIG. 37 depicts a cross sectional view of a representation of an embodiment of a distal portion of a fourth conduit of the pouring spout assembly depicted in FIG. 25.
Figure 40:
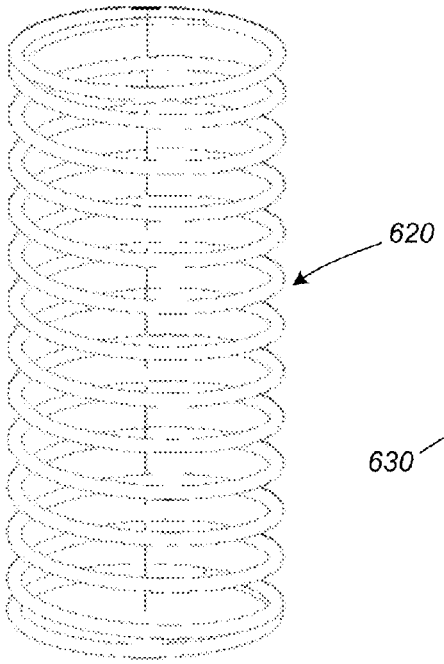
FIG. 40 depicts a perspective view of a representation of an embodiment of a fourth conduit spring of the pouring spout assembly depicted in FIG. 25.

As the second conduit 510 moves from the first position (e.g., FIG. 26) at the distal end of the pouring spout assembly 110 to the second position (e.g., FIGS. 42-43) at the proximal end of the pouring spout assembly, the second conduit conveys the fourth conduit 530 (e.g., FIGS. 36-37, which is coupled to the second conduit 510, e.g., FIG. 26) allowing gases to flow through the fourth conduit. In some embodiments, a first elastically deformable member 620 (e.g., FIGS. 26, 40, and 43) may be positioned in the third conduit 520. The first elastically deformable member 620 functions to apply a first force against the second conduit 510 such that the second conduit is biased towards the first position. The first elastically deformable member may include a spring.

Figure 34:
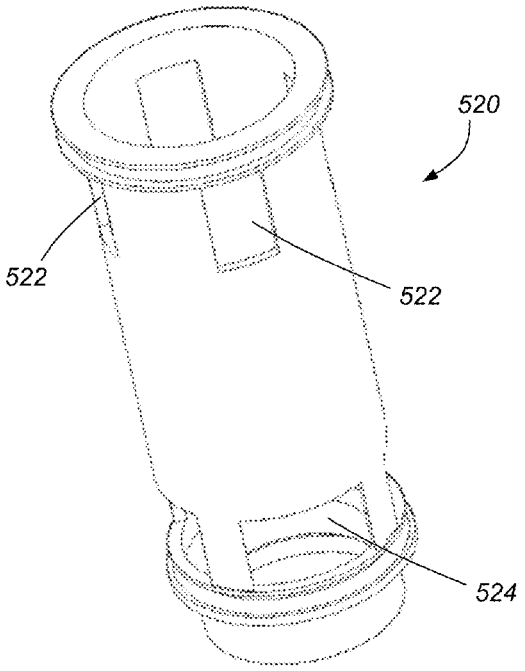
FIG. 34 depicts a perspective view of a representation of an embodiment of a third conduit of the pouring spout assembly depicted in FIG. 25.
Figure 35:
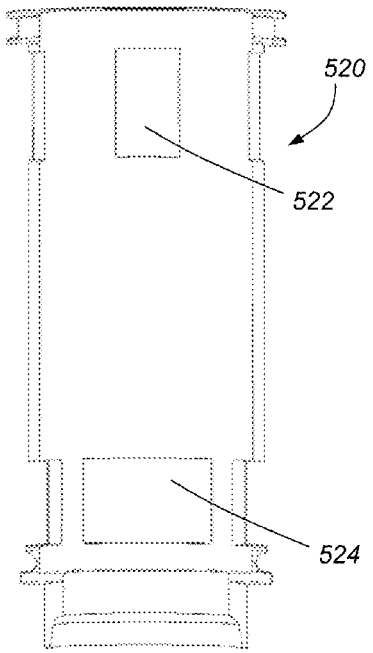
FIG. 35 depicts a cross sectional view of a representation of an embodiment of a third conduit of the pouring spout assembly depicted in FIG. 25.
Figure 41:
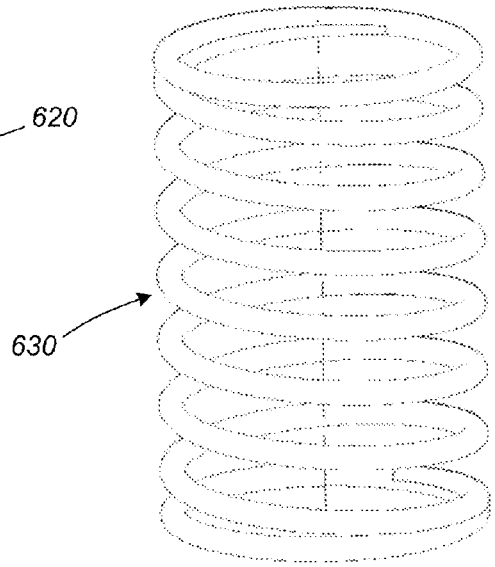
FIG. 41 depicts a perspective view of a representation of an embodiment of a third conduit spring of the pouring spout assembly depicted in FIG. 25.
Figure 42:
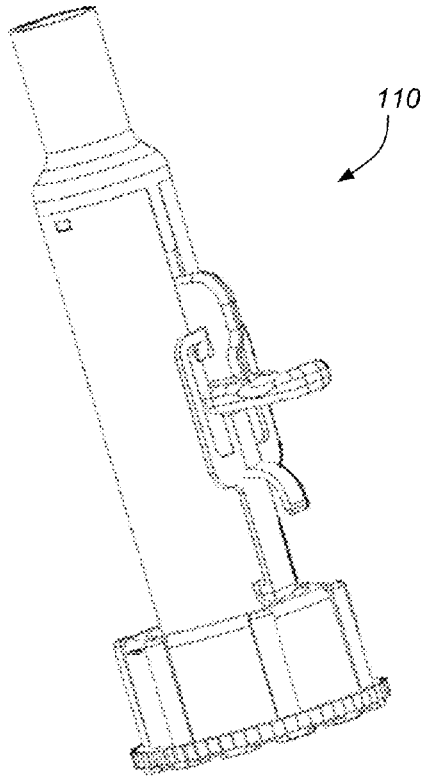
FIG. 42 depicts a perspective view of a representation of an embodiment of the pouring spout assembly depicted in FIG. 25 in a vented position such that gases are allowed to exit but liquids are inhibited from exiting.
Figure 43:
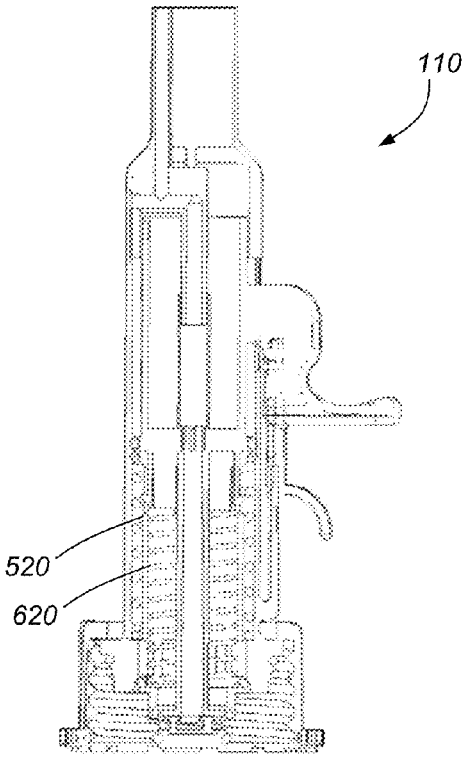
FIG. 43 depicts a cross sectional view of a representation of an embodiment of the pouring spout assembly depicted in FIG. 25 in a vented position such that gases are allowed to exit but liquids are inhibited from exiting.

As the second conduit 510 moves from the second position (wherein a proximal end is substantially adjacent or abuts a distal end of the third conduit, e.g., FIGS. 42-43) to the third position (e.g., FIGS. 44-45), the second conduit conveys the third conduit 520 (e.g., FIGS. 34-35) toward a proximal end of the pouring spout assembly allowing liquids to flow through the third conduit (e.g., openings 524 of the third conduit) and out the pouring spout assembly. In some embodiments, a second elastically deformable member 630 (e.g., FIGS. 26, 41, and 45) may be positioned in the first conduit 500. The second elastically deformable member 630 functions to apply a second force against the third conduit 520 such that the third conduit is biased towards the second position. The second elastically deformable member may include a spring. In some embodiments, the second force may be greater than the first force. The second force may be greater than the first force such that a user is able to detect a transition point (e.g., at the second position) when moving the second conduit from the first position to the third position.

Figure 32:
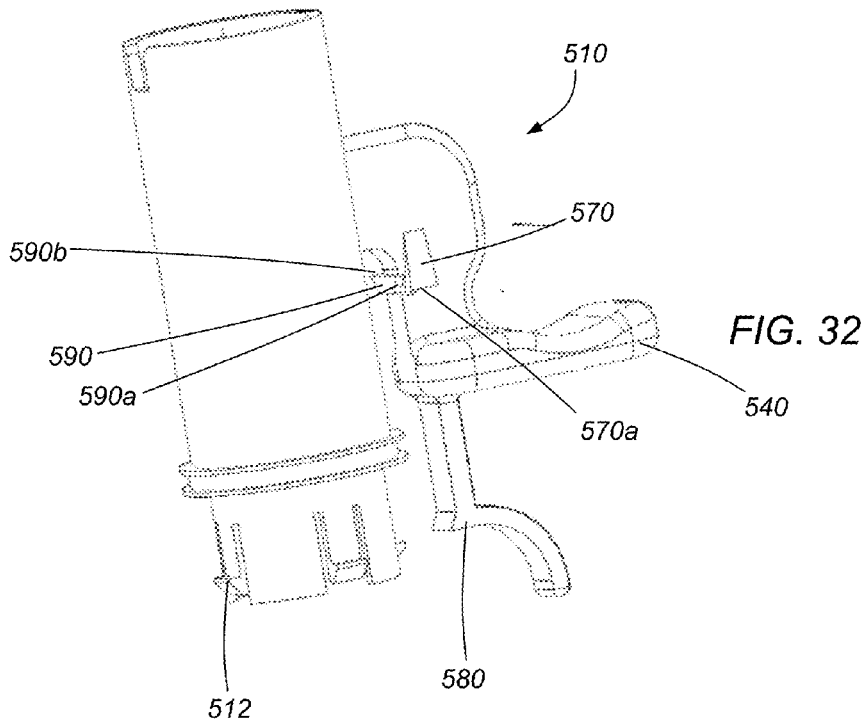
FIG. 32 depicts a perspective view of a representation of an embodiment of a second conduit of the pouring spout assembly depicted in FIG. 25.
Figure 33:
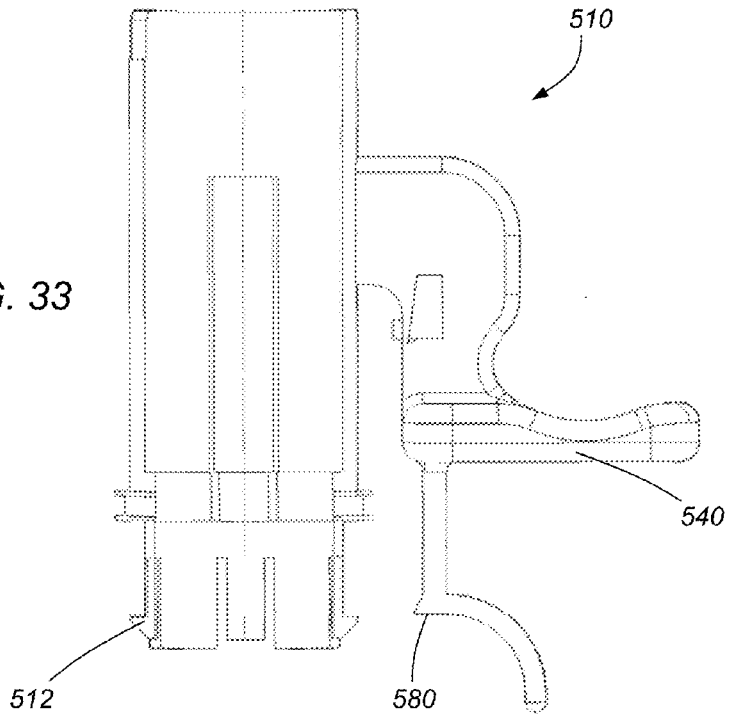
FIG. 33 depicts a cross sectional view of a representation of an embodiment of a second conduit of the pouring spout assembly depicted in FIG. 25.

In some embodiments, the second conduit 510 may be coupled to the third conduit 520. The second conduit 510 may be coupled to the third conduit 520 using tabs 512 (e.g., FIGS. 32-33) and openings 522 (e.g., FIGS. 34-35). The tabs 512 and openings 522 may couple the second conduit 510 and the third conduit 520 while allowing the second conduit 510 to move relative to the third conduit 520 as the tabs 512 slide within the openings 522 during use.

Figure 27:
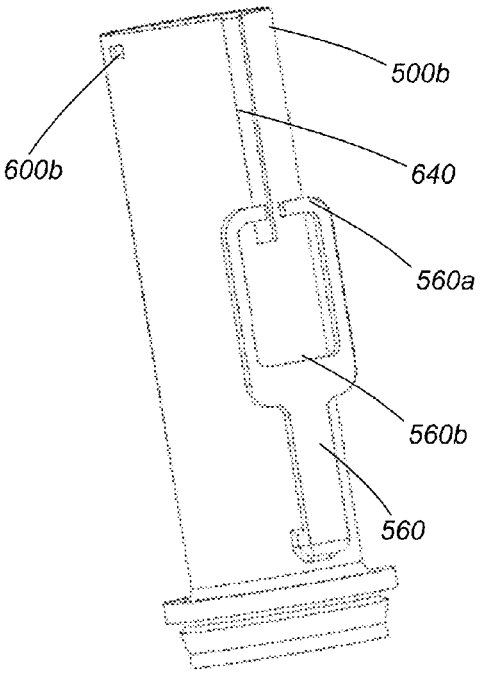
FIG. 27 depicts a perspective view of a representation of an embodiment of a proximal portion of a first conduit of the pouring spout assembly depicted in FIG. 25.
Figure 28:
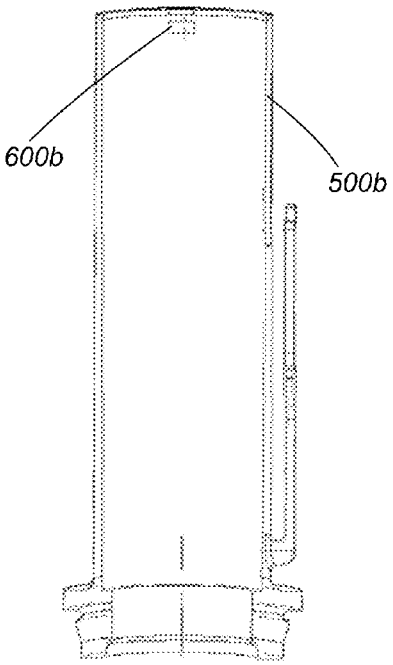
FIG. 28 depicts a cross sectional view of a representation of an embodiment of a proximal portion of a first conduit of the pouring spout assembly depicted in FIG. 25.

The second conduit 510 may be repositioned by a user using the handle 540. The handle 540 may be coupled to the second conduit 510. In some embodiments, the handle 540 is coupled to the second conduit 510 through an elongated opening 640 (e.g., FIG. 27) in the first conduit allowing the handle 540 and the second conduit 510 to move relative to the first conduit 500.

Figure 29:
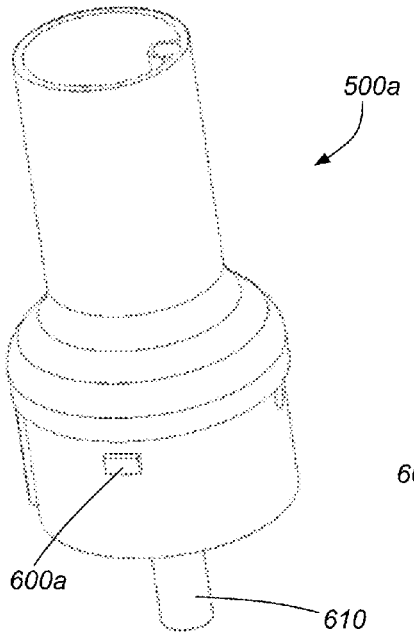
FIG. 29 depicts a perspective view of a representation of an embodiment of a distal portion of a first conduit of the pouring spout assembly depicted in FIG. 25.
Figure 30:
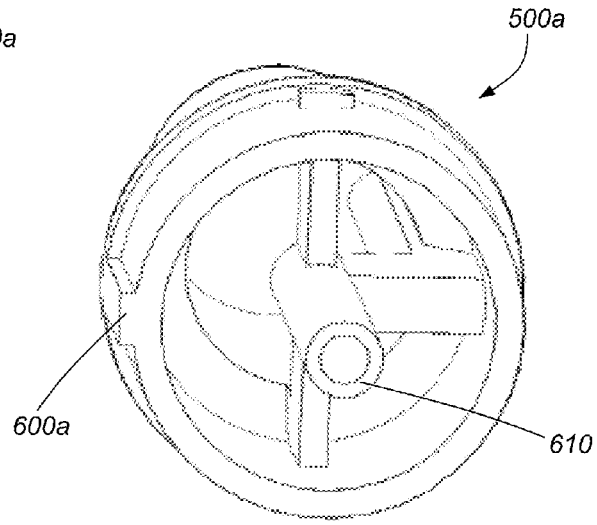
FIG. 30 depicts a perspective view of a representation of an embodiment of a distal portion of a first conduit of the pouring spout assembly depicted in FIG. 25.
Figure 31:
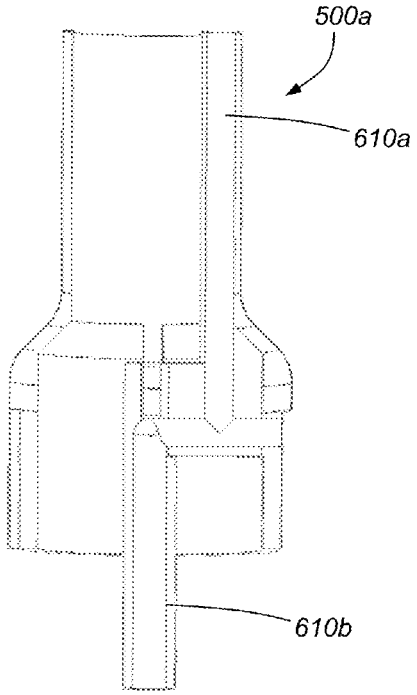
FIG. 31 depicts a cross sectional view of a representation of an embodiment of a distal portion of a first conduit of the pouring spout assembly depicted in FIG. 25.

In some embodiments, the first conduit 500 may include two portions, the proximal portion 500*b* (e.g., FIGS. 27-28) and the distal portion 500*a* (e.g., FIGS. 29-31). The distal portion 500*a* may include a reduced diameter at a distal end of the distal portion. The reduced diameter may assist in pouring liquids out of the pouring spout. The distal end of the distal portion may have a diameter according to local and/or federal laws and/or regulations. In some embodiments, the distal portion 500*a* may be coupled to proximal portion 500*b* (e.g., using a tab 600*a* and slot 600*b* coupling system as depicted in FIGS. 27-31).

In some embodiments, a pouring spout assembly 110 may include a fifth conduit 610 (e.g., FIGS. 26 and 29-31). The fifth conduit 610 may include a distal end 610*a* coupled to the first conduit 500 and a proximal end 610*b* functionally coupled to the fourth conduit 530. The proximal end 610*b* may be functionally coupled to the fourth conduit 530 such that as the second conduit moves, during use, the fourth conduit moves in parallel fashion relative to the first and fifth conduits. Although the fourth conduit moves relative to the fifth conduit the two conduits remain coupled to one another such that gases are conveyable between the fourth and fifth conduits.

Figure 38:
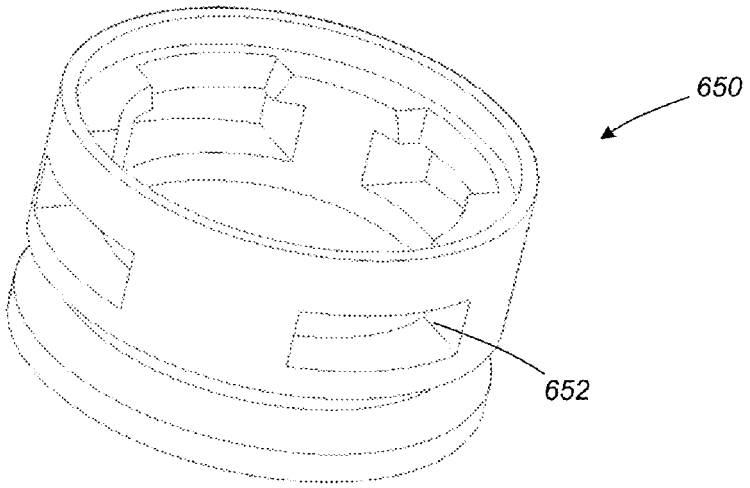
FIG. 38 depicts a perspective view of a representation of an embodiment of a distal portion of a fourth conduit of the pouring spout assembly depicted in FIG. 25.
Figure 39:
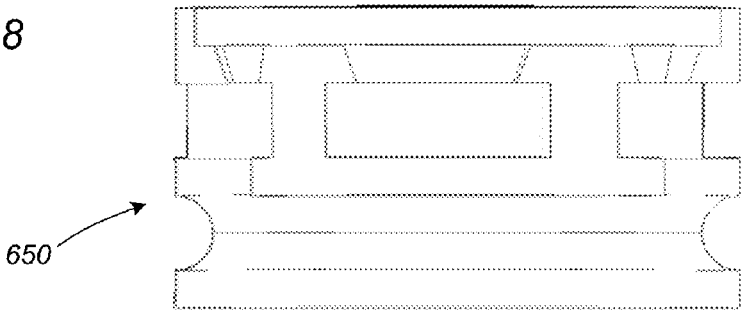
FIG. 39 depicts a cross sectional view of a representation of an embodiment of a distal portion of a fourth conduit of the pouring spout assembly depicted in FIG. 25.

In some embodiments, the fourth conduit 530 may include a cap 650 (e.g., FIGS. 38-39). The cap 650 may inhibit liquids from being conveyed through the fourth conduit 530 while allowing gases to enter opening 652. Openings 652 may function to couple the cap 650 to the fourth conduit 530 using tabs 532.

In some embodiments, the spout lock 550 inhibits, during use, movement of the second conduit 510 from the first position to the second position when the spout lock 550 is engaged. The spout lock 550 may include a first elongated member 560 (e.g., FIGS. 27-28). The first elongated member may be coupled to the first conduit 500. When a first portion 560*a* of the first elongated member 560 engages a raised portion 570*a*, of a first projection 570 coupled to the handle 540 (e.g., FIGS. 32-33), the spout lock 550 is engaged. As such to disengage the spout lock 550 a user needs to flex the first elongated member 560 towards the first conduit 500 such that the first portion 560*a* disengages from the raised portion 570*a*.

In some embodiments, when the spout lock 550 is engaged, an extension 580 (e.g., FIGS. 32-33) of the handle 540 engages a second portion 560*b* of the first elongated member 560 (e.g., FIGS. 25-26) inhibiting movement of the second conduit 510 from the first position to the second position. As such to disengage the spout lock 550 a user needs to flex the extension 580 away the first conduit 500 such that the extension 580 disengages from the second portion 560*b* of the first elongated member 560.

Figure 25:
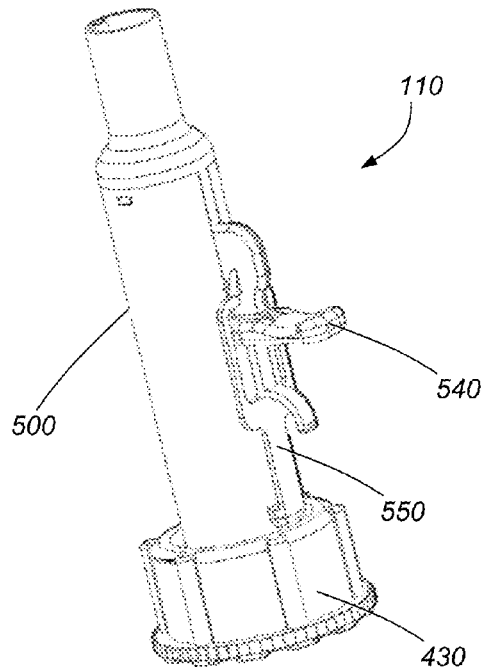
FIG. 25 depicts a perspective view of a representation of an embodiment of a pouring spout assembly in a closed position.
Figure 26:
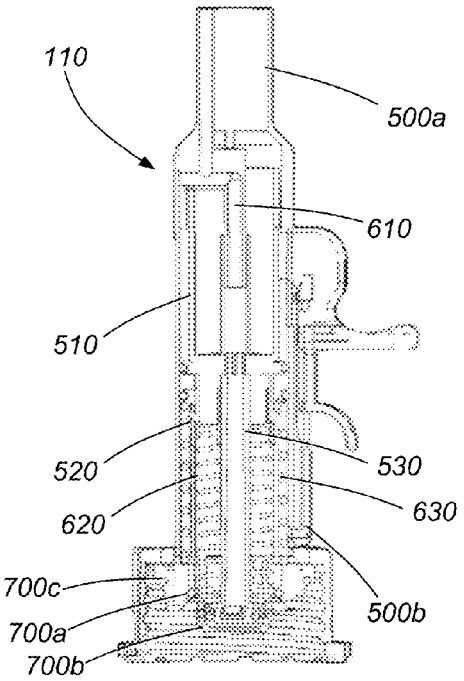
FIG. 26 depicts a cross sectional view of a representation of an embodiment of the pouring spout assembly depicted in FIG. 25.
Figure 46:
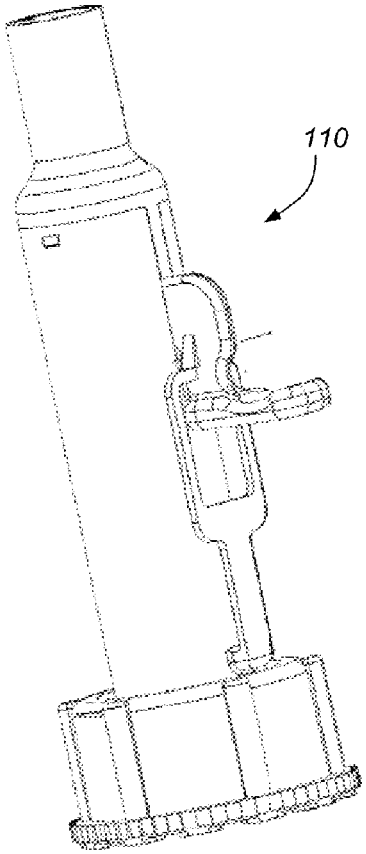
FIG. 46 depicts a perspective view of a representation of an embodiment of a pouring spout assembly in a closed position.
Figure 47:
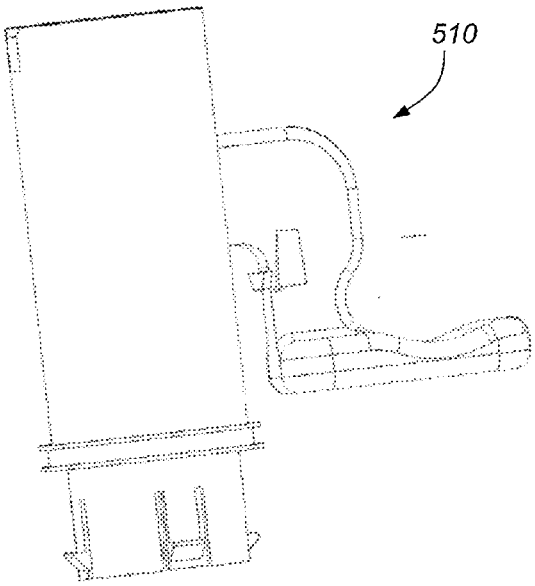
FIG. 47 depicts a perspective view of a representation of an embodiment of a second conduit of the pouring spout assembly depicted in FIG. 46.

In some embodiments, the spout lock 550 may include both the first portion 560*a* of the first elongated member 560 engaging the raised portion 570*a* and the extension 580 of the handle 540 engaging the second portion 560*b* (e.g., FIGS. 25-26). As such to disengage the spout lock 550 a user needs to flex the first elongated member 560 towards the first conduit 500 such that the first portion 560*a* disengages from the raised portion 570*a* and to flex the extension 580 away the first conduit 500 such that the extension 580 disengages from the second portion 560*b* of the first elongated member 560. Therein you have a two-step process for disengaging the spout lock increasing the difficulty of disengaging the spout lock and increasing the child safety factor of the pouring spout. In some embodiments, the spout lock 550 may not include the extension 580 (e.g., FIGS. 46-47).

In some embodiments, the spout lock 550 may include a second projection 590. The second projection 590 may include a ramped surface 590*a* (e.g., for each first portion 560*a*) (e.g., FIG. 32). The ramped surface 590*a* may function to convey the first portions 560*a* away from handle 540. The ramped surface 590*a* may function to convey the first portions 560*a* away from handle 540 such that the first portions do not incidentally engage the handle inhibiting conveyance of the first portions past the handle as the second conduit moves from the first position to at least the second position. In some embodiments, after the first portions 560*a* have moved beyond the second projection 590 surface 590*b* may function to inhibit the second conduit 510 from moving from the second position back to the first position (i.e., such that the second conduit remains locked in the second position allowing venting of gases). After the first portions 560*a* have moved beyond the second projection 590 surface 590*b* may function to inhibit the second conduit 510 from moving from the second position back to the first position until the second conduit moves from the second position to the third position.

In some embodiments, a pouring spout assembly 110 may include one or more seals 700 (e.g., FIG. 26). A seal 700*a* may be coupled to the proximal end of the third conduit 520 which inhibits, during use, liquids from being conveyed through the proximal end of the third conduit when the second conduit 510 is in the first position. A seal 700*b* may be coupled to the proximal end of the fourth conduit 530 which inhibits, during use, gases from being conveyed through the proximal end of the fourth conduit when the second conduit 510 is in the first position. A seal 700*c* may be coupled to the proximal end of the first conduit 500 which inhibits, during use, liquids and gases from being conveyed around an exterior of the proximal end of the first conduit. Seals may be elastically deformable. Seals may be pliable. Seals may be formed from materials including such properties which are resistant to solvents and/or caustic fluids such as gasoline (e.g., rubber, silicone based polymers, etc.). Seals may be formed from a fluoroelastomer that gives good service in the gasoline environment. Fluoroelastomers may vary in fluorine content from about 66% to 70%. Materials which are desirable may include the best combination of functional sealing, mechanical hysteresis, and durability In some embodiments, a pouring spout assembly 110 may include a cap 430 (e.g., depicted in FIGS. 10-11). The cap 430 may function to couple the first conduit 500 to the container 100 (e.g., depicted in FIG. 1). When engaged to the container, the cap may inhibit movement of the first conduit relative to the container. The first conduit may be positionable in a cap opening 440 (e.g., depicted in FIGS. 10-11). The proximal end of the first conduit may be dimensioned such that the proximal end does not pass through the cap opening. In some embodiments, the cap may include a cap lock 450 which inhibits, during use, removal of the cap from the container. The cap lock may function to inhibit inadvertent removal of the cap and the spout assembly from the container. The cap lock may function in combination with portions of the container to inhibit removal. Caps may be interchangeable with pouring spout assemblies such that different types of caps may be used to work in combination with different containers including different locking mechanisms. In some embodiments cap locks may include cap locking mechanisms known to one skilled in the art.

In some embodiments, at least portions of the pouring spout assembly may be formed from materials including such properties which are resistant to solvents and/or caustic fluids such as gasoline (e.g., plastics, polymers, etc.). Portions of the pouring spout assembly may be formed from a rigid or semi rigid plastic such as polyolefins (Polyethylene, polypropylene, etc.), nylons, polyester, etc.

Vented Pouring Spout with Advanced Pouring Rate

Figure 48A:
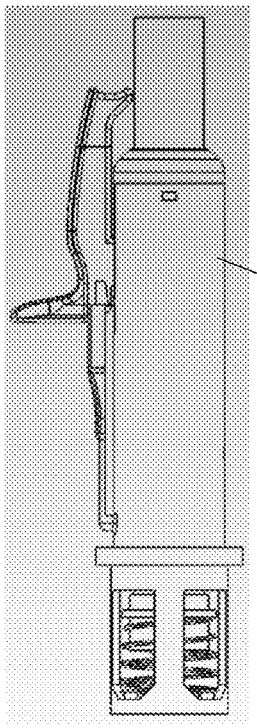
FIG. 48A depicts a side view of a representation of an embodiment of a pouring spout assembly in a closed position.
Figure 48B:
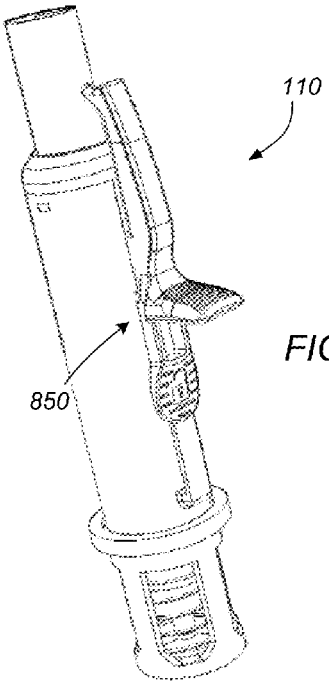
FIG. 48B depicts a perspective view of a representation of an embodiment of a pouring spout assembly in a closed position.
Figure 49:
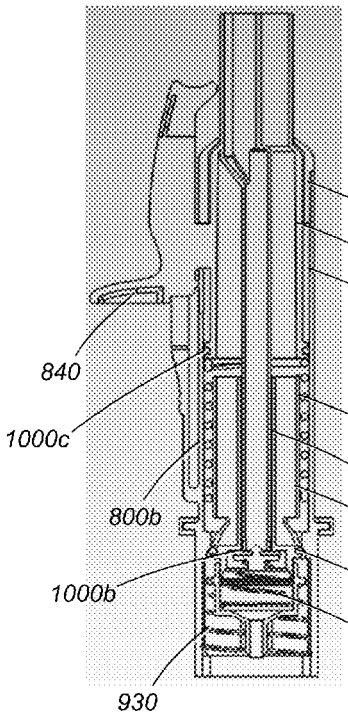
FIG. 49 depicts a cross sectional view of a representation of an embodiment of the pouring spout assembly depicted in FIG. 48.
Figure 50:
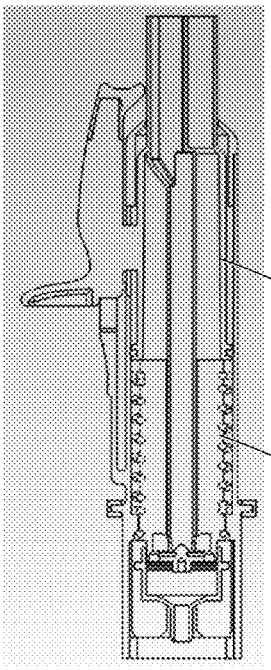
FIG. 50 depicts a cross sectional view of a representation of an embodiment of the pouring spout assembly depicted in FIG. 48 in a vented position such that gases are allowed to exit but liquids are inhibited from exiting.
Figure 51:
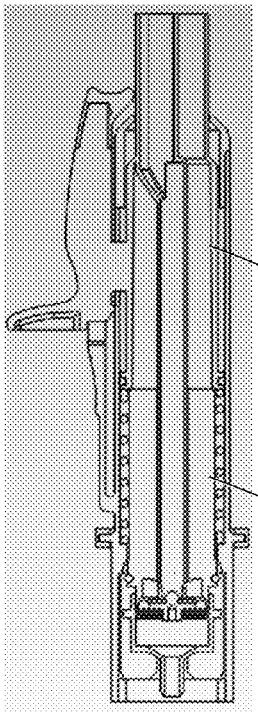
FIG. 51 depicts a cross sectional view of a representation of an embodiment of the pouring spout assembly depicted in FIG. 48 in a vented position such that gases and liquids are allowed to exit.
Figure 52:
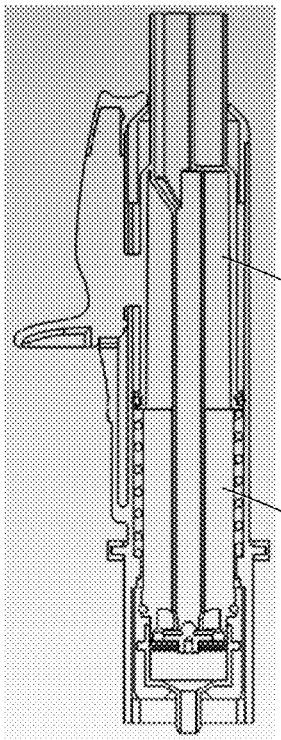
FIG. 52 depicts a cross sectional view of a representation of an embodiment of the pouring spout assembly depicted in FIG. 48 in a vented position such that gases and liquids are allowed to exit wherein at least the liquids flow out faster than in the pouring spout assembly depicted in FIG. 51.

In some embodiments, a system and/or method may include a pouring spout assembly 110 for a container. In some embodiments, the pouring spout assembly 110 may include a first conduit 800, a second conduit 810, a third conduit 820, a fourth conduit 830, a handle 840, and a spout lock 850. The second conduit 810 may be at least partially positionable, during use, in a distal end 800*a* of the first conduit 800. The third conduit 820 may be positionable, during use, in a proximal end 800*b* of the first conduit 800. The fourth conduit 830 may be coupled to the second conduit 810. In some embodiments, the fourth conduit 830 and the second conduit 810 may be formed as a single piece during manufacture. When the second conduit 810 is in a first position (e.g., as depicted in FIGS. 48-49) liquids and gases may be inhibited from being conveyed from the container 100 through the pouring spout assembly 110. When the second conduit 810 is in a second position (e.g., as depicted in FIG. 50) gases are allowed to convey from the container 100 through the pouring spout assembly 110. When the second conduit 810 is in a third position (e.g., as depicted in FIG. 51) liquids are allowed to convey from the container 100 through the pouring spout assembly 110. When the second conduit 810 is in a fourth position (e.g., as depicted in FIG. 52) liquids are allowed to convey from the container 100 through the pouring spout assembly 110 at an increased rate relative to when the second conduit 810 is in the third position. As such, in some embodiments, opening the pouring spout assembly to pour liquids (e.g., gas) may include two steps wherein as the second conduit moves from the first position (e.g., as depicted in FIGS. 48-49) to the second position (e.g., as depicted in FIG. 50) gases are vented (especially in the case of pressure build up) and as the second conduit moves from the second position to the third position (e.g., as depicted in FIG. 51) liquids are allowed to exit through the pouring spout assembly.

Figure 60:
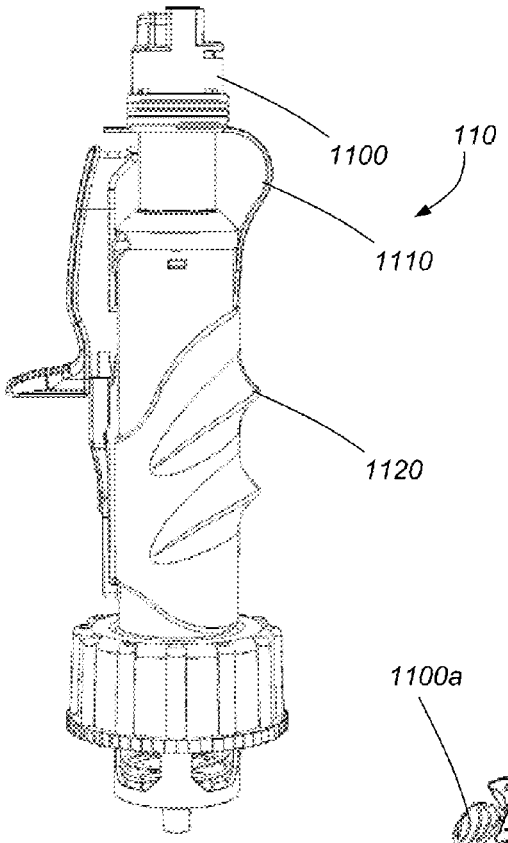
FIG. 60 depicts a side view of a representation of an embodiment of a pouring spout assembly including a closure mechanism.
Figure 61:
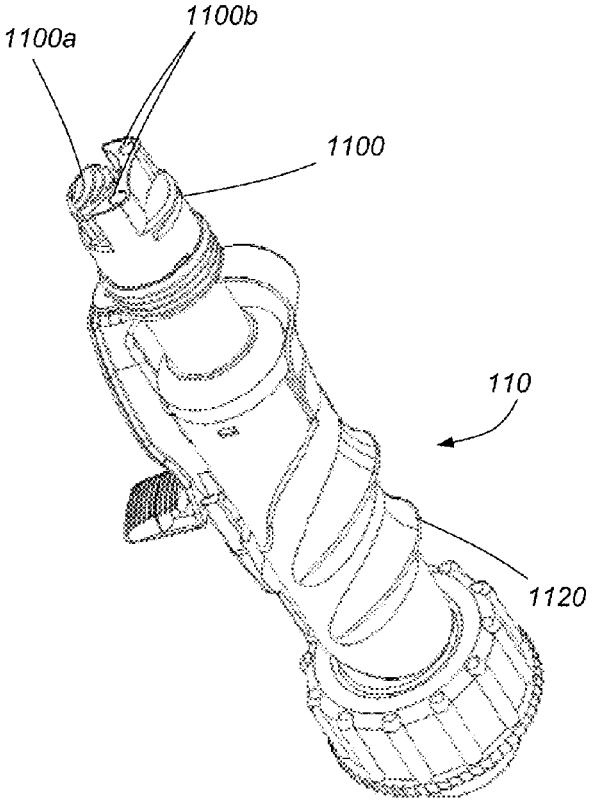
FIG. 61 depicts a perspective view of a representation of an embodiment of a pouring spout assembly including a closure mechanism.
Figure 62:
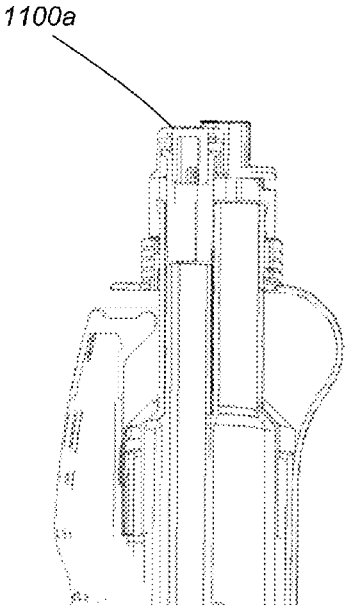
FIG. 62 depicts a cross-sectional view of a representation of an embodiment of a pouring spout assembly including a closure mechanism.

In some embodiments, the pouring spout assembly 110 may include a closure mechanism. A gas container may during the course of use become agitated and/or heated (e.g., on a warm day) resulting in the contents becoming pressurized possibly resulting in liquids and/or vapor spraying out of the container when opened. A closure mechanism may inhibit this type of occurrence from happening. FIGS. 60-62 depict views of a representation of an embodiment of a pouring spout assembly 110 including a closure mechanism 1100. The closure mechanism may be coupled to a distal end of the pouring spout assembly such that when activated (e.g., the closure mechanism may be activated by coupling to a distal end of the pouring spout assembly) the closure mechanism inhibits liquids from exiting a distal end of the pouring spout mechanism prematurely. The closure mechanism may be activated by coupling (e.g., by threading, friction fit, etc.) to the opening of the distal end of the pouring spout mechanism.

In some embodiments, the closure mechanism may inhibit gasses and/or liquids from leaving the pouring spout mechanism (e.g., by blocking one or more conduits of the pouring spout mechanism). In some embodiments, the closure mechanism may function as an anti-spray feature. In some embodiments, the closure mechanism must be removed to pour as it does block flow of liquids. In some embodiments, the vapor or any mist that gets entrained enters that closure mechanism and encounters a portion 1100*a* (e.g., positioned at least partially in the fourth conduit) and redirects to reach one or more outlet holes (e.g., two outlet holes 1100*b*) that do go through. The idea is that the mist will impinge on the portion 1100*a* (which functions as a baffle) and stay while the air and vapors escape through the two openings 1100*b*.

The closure mechanism may be further coupled (e.g., using an elongated member 1110) to the pouring spout mechanism even when in the inactivated state (i.e., such that liquids are allowed to flow out of the distal end of the pouring spout mechanism) such that the closure mechanism may not be lost.

In some embodiments, the pouring spout assembly 110 may include a gripping mechanism 1120. The gripping mechanism may assist a user in firmly holding the pouring spout assembly. The gripping mechanism may be molded to fit a user's hand.

Figure 56A:
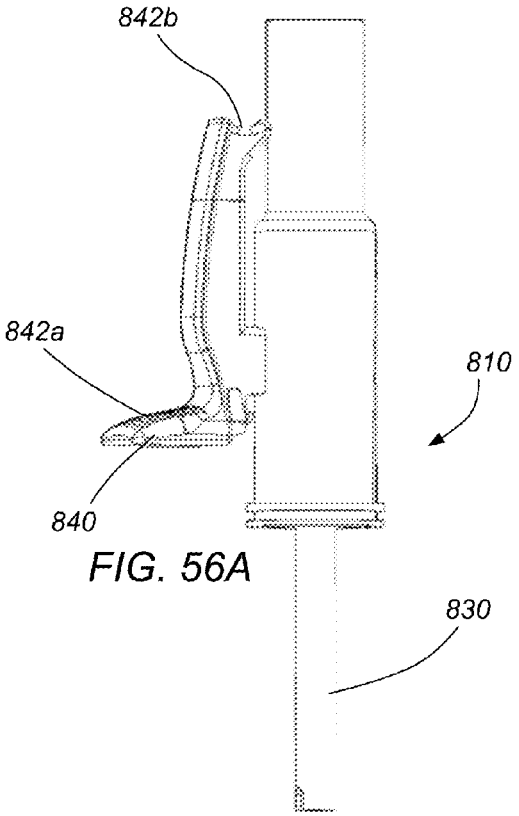
FIG. 56A depicts a perspective view of a representation of an embodiment of a second and a fourth conduit of the pouring spout assembly depicted in FIG. 48.
Figure 57:
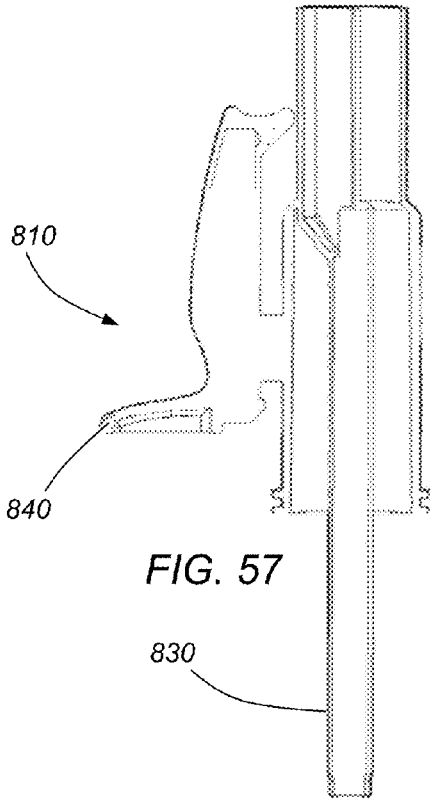
FIG. 57 depicts a cross sectional view of a representation of an embodiment of a second and a fourth conduit of the pouring spout assembly depicted in FIG. 48.

As the second conduit 810 moves from the first position (e.g., as depicted in FIG. 49) at the distal end of the pouring spout assembly 110 to the second position (e.g., as depicted in FIG. 50) toward the proximal end of the pouring spout assembly, the second conduit conveys the fourth conduit 830 (e.g., as depicted in FIGS. 56A and 57) allowing gases to flow through the fourth conduit. In some embodiments, a first elastically deformable member 920 (e.g., as depicted in FIG. 49) may be positioned in the third conduit 820. The first elastically deformable member 920 functions to apply a first force against the fourth conduit 830 such that the fourth conduit is biased towards the first position. In some embodiments, the first elastically deformable member may include a spring.

Figure 58:
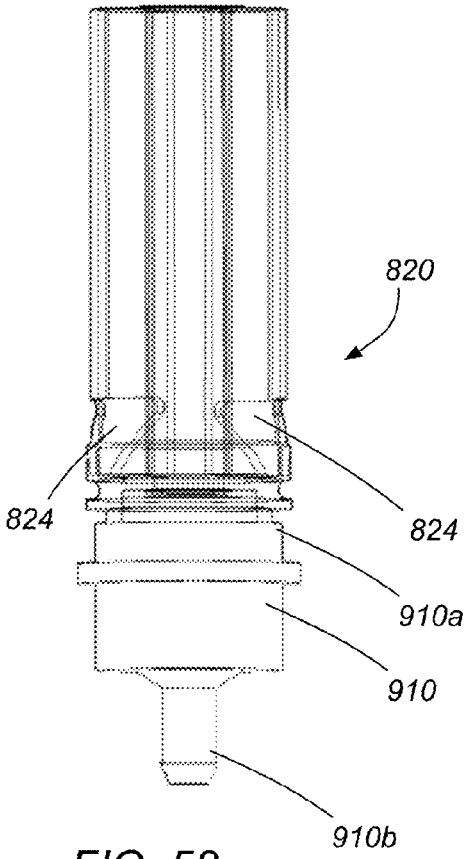
FIG. 58 depicts a perspective view of a representation of an embodiment of a third conduit of the pouring spout assembly depicted in FIG. 48.
Figure 59:
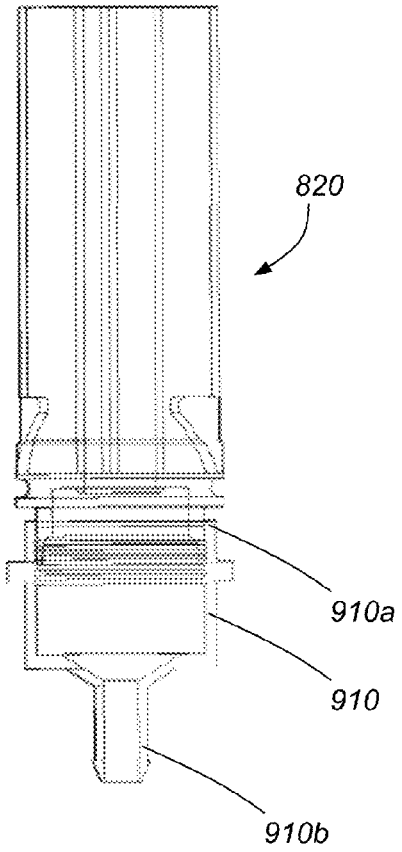
FIG. 59 depicts a cross sectional view of a representation of an embodiment of a third conduit of the pouring spout assembly depicted in FIG. 48.

As the second conduit 810 moves from the second position (wherein a proximal end is substantially adjacent or abuts a distal end of the third conduit, e.g., as depicted in FIG. 50) to the third position (e.g., as depicted in FIG. 51), the second conduit conveys the third conduit 820 (e.g., as depicted in FIGS. 58-59) toward a proximal end of the pouring spout assembly allowing liquids to flow through the third conduit (e.g., openings 824 of the third conduit) and out the pouring spout assembly. In some embodiments, a second elastically deformable member 930 (e.g., as depicted in FIG. 49) may be positioned in the first conduit 800 adjacent a proximal end of the third conduit 820. The second elastically deformable member 930 may function to apply a second force against the third conduit 820 such that the third conduit is biased towards the second position. The second elastically deformable member may include a spring. In some embodiments, the second force may be greater than the first force. The second force may be greater than the first force such that a user is able to detect a transition point (e.g., at the second position) when moving the second conduit from the second position to the third position.

As the second conduit 810 moves from the third position (wherein a proximal end is substantially adjacent or abuts a distal end of the third conduit, e.g., as depicted in FIG. 50) to a fourth position (e.g., as depicted in FIG. 51), the second conduit conveys the third conduit 820 (e.g., as depicted in FIGS. 58-59) toward a proximal end of the pouring spout assembly allowing liquids to flow through the third conduit (e.g., openings 824 of the third conduit) and out the pouring spout assembly. In some embodiments, a third elastically deformable member 980 (e.g., as depicted in FIG. 49) may be positioned in a proximal end of the first conduit 800 positioned between the first conduit 800 and the third conduit 820. The third elastically deformable member 980 may function to apply a third force against the second conduit 810 such that the second conduit is biased towards the third position. The third elastically deformable member may include a spring. In some embodiments, the third force may be greater than the second force. The third force may be greater than the second force such that a user is able to detect a transition point (e.g., at the third position) when moving the second conduit from the third position to the fourth position.

In some embodiments, the second conduit 810 may be coupled to the third conduit 820 while allowing the second conduit 810 to move relative to the third conduit 820 during use.

Figure 54A:
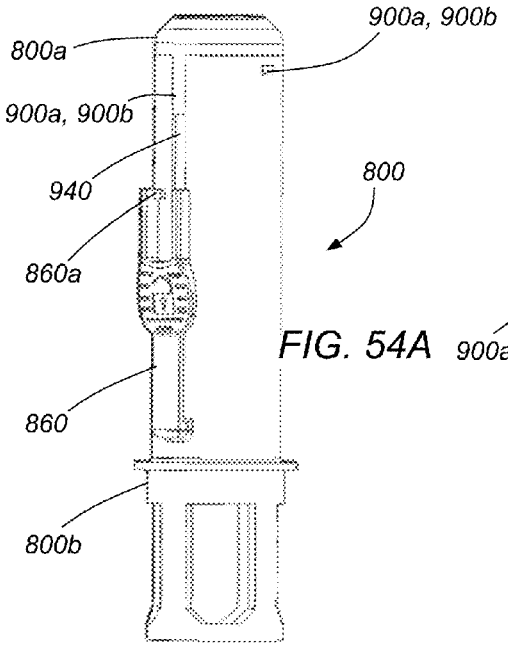
FIG. 54A depicts a perspective view of a representation of an embodiment of a first conduit of the pouring spout assembly depicted in FIG. 48.

The second conduit 810 may be repositioned by a user using the handle 840. The handle 840 may be coupled to the second conduit 810. In some embodiments, the handle 840 is coupled to the second conduit 810 through an elongated opening 940 (e.g., as depicted in FIGS. 54A and C) in the first conduit allowing the handle 840 and the second conduit 810 to move relative to the first conduit 800.

In some embodiments, the handle 840 may include multiple positions of engagement. For example, handle 840 may include engagement 842*a*. Engagement 842*a* may be engaged by a user using a finger, thumb, or portion of the user's hand. The handle 840 may include engagement 842*b*. Engagement 842*b* may be engaged by a user using, for example, a lip of an opening of a receptacle such that after the lock is disengaged the notch of engagement 842*b* may be pressed against the lip allowing fluids to come out of the pouring spout assembly 110.

Figure 54B:
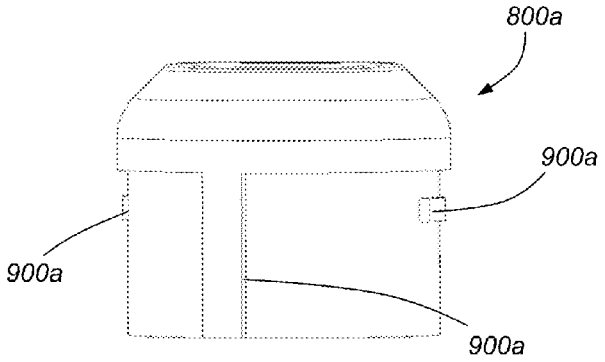
FIG. 54B depicts a perspective view of a representation of an embodiment of a distal portion of a first conduit of the pouring spout assembly depicted in FIG. 48.
Figure 54C:
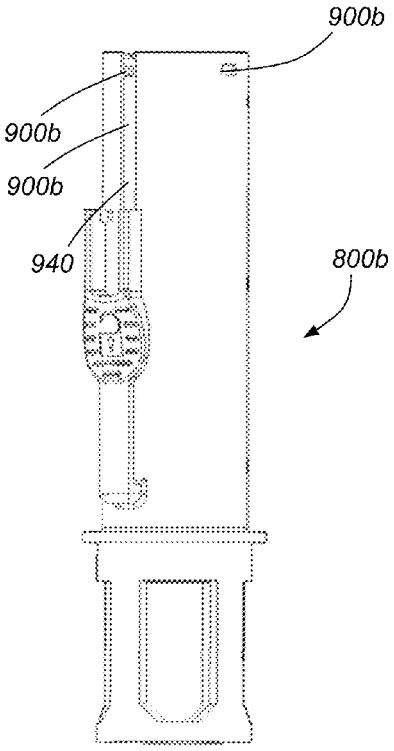
FIG. 54C depicts a perspective view of a representation of an embodiment of a proximal portion of a first conduit of the pouring spout assembly depicted in FIG. 48.
Figure 55:
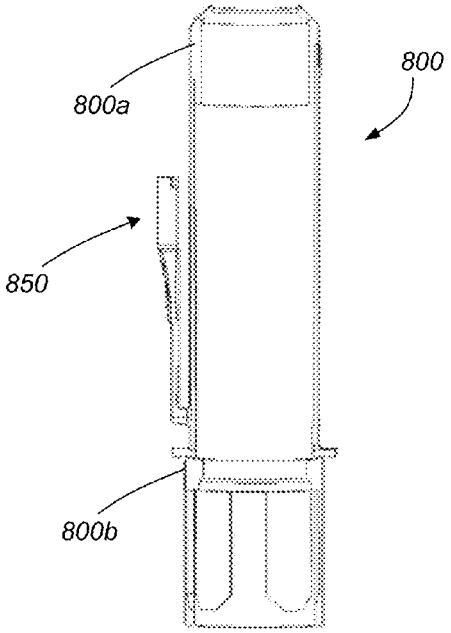
FIG. 55 depicts a cross sectional view of a representation of an embodiment of a first conduit of the pouring spout assembly depicted in FIG. 48.

In some embodiments, the first conduit 800 may include two portions, the proximal portion 800*b* (e.g., as depicted in FIG. 54C) and the distal portion 800*a* (e.g., as depicted in FIG. 54B). The distal portion 800*a* may include a reduced diameter at a distal end of the distal portion. The reduced diameter may match a reduced diameter of a distal portion of the second conduit 810. In some embodiments, the distal portion 800*a* may be coupled to proximal portion 800*b* (e.g., using a tab 900*a* and slot 900*b* coupling system as depicted in FIGS. 54B-C).

Figure 53:
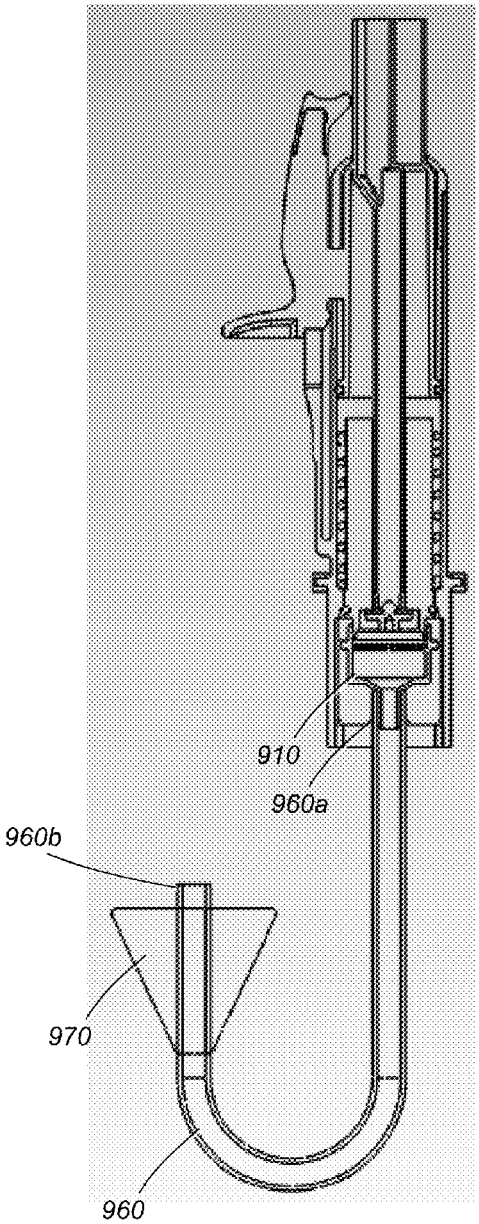
FIG. 53 depicts a cross sectional view of a representation of an embodiment of the pouring spout assembly depicted in FIG. 48 in a closed position with an elongated conduit and float coupled to a proximal end of the third conduit.

In some embodiments, a pouring spout assembly 110 may include a fifth conduit 910 (e.g., as depicted in FIGS. 58-59). The fifth conduit 910 may include a distal end 910*a* coupled to the third conduit 820. In some embodiments, a proximal end 910*b* may be couplable to an elongated flexible conduit 960 (e.g., as depicted in FIG. 53). The elongated flexible conduit 960 may include a first end 960*a* coupled to the proximal end of the fifth conduit 910. The elongated flexible conduit 960 may include a second end 960*b* couplable to a shaped floatable member 970 (e.g., as depicted in FIG. 53). The shaped floatable member may elevate, during use, an opening in the second end 960*b* of the elongated flexible conduit 960 above a liquid within the container. The shaped floatable member may ensure that liquids within the container do not enter the elongated flexible conduit allowing increased flow of liquids out of the pouring spout assembly (e.g., the flow rate may be increase by at least 20%, for example from greater than 8 LPM to greater than 10 LPM). The float may be shaped to ensure the second end is directed above a level of the liquids in the container (e.g., cone shaped with the second end extending out of the larger end of the cone). The float may include closed cell foam construction.

In some embodiments, the fourth conduit 830 may include a cap 950 (e.g., as depicted in FIG. 49) coupled to a proximal end 830*a* of the fourth conduit. The cap 950 may inhibit liquids from being conveyed through the fourth conduit 830 while allowing gases to enter openings 952. A distal end 830*b* of the fourth conduit may include an opening with an expanded diameter relative to the proximal end of the fourth conduit. The expanded diameter may allow for increased flow of air into the container as liquids are poured out of the container through the pouring spout. In some embodiments, the distal end of the fourth conduit maybe positioned adjacent a distal end of the second conduit wherein liquids exit from the container. The distal end of the fourth conduit maybe positioned adjacent a distal end of the second conduit such that as liquids are poured into another receptacle if the liquids in the receptacle fill up above the distal end of the fourth conduit air is inhibited from entering the fourth conduit inhibiting liquids from pouring out of the container through the second conduit. As such this effectively acts as an automatic shut off to help prevent overfilling the receptacle.

Figure 56B:
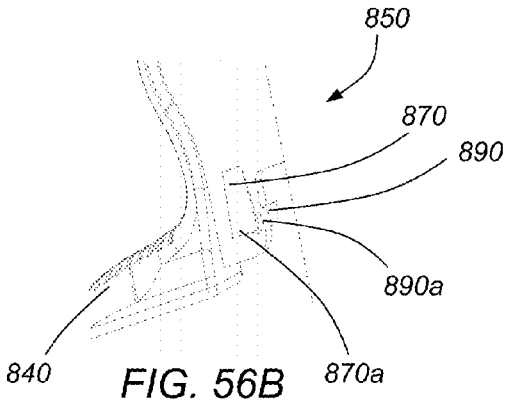
FIG. 56B depicts a perspective view of a representation of an embodiment of a portion of a locking mechanism coupled to a second conduit of the pouring spout assembly depicted in FIG. 48.

In some embodiments, the spout lock 850 inhibits, during use, movement of the second conduit 810 from the first position to the second position when the spout lock 850 is engaged. The spout lock 850 may include a first elongated member 860 (e.g., as depicted in FIG. 54A). The first elongated member may be coupled to the first conduit 800. When a first portion 860*a* of the first elongated member 860 engages a raised portion 870*a*, of a first projection 870 coupled to the handle 840 (e.g., as depicted in FIG. 56B), the spout lock 850 is engaged. As such to disengage the spout lock 850 a user needs to flex the first elongated member 860 towards the first conduit 800 such that the first portion 860*a* disengages from the raised portion 870*a*.

In some embodiments, the spout lock 850 may include a second projection 890. The second projection 890 may include a ramped surface 890*a* (e.g., for each first portion 860*a*) (e.g., as depicted in FIG. 56B). The ramped surface 890*a* may function to convey the first portions 860*a* away from handle 840. The ramped surface 890*a* may function to convey the first portions 860*a* away from handle 840 such that the first portions do not incidentally engage the handle inhibiting conveyance of the first portions past the handle as the second conduit moves from the first position to at least the second position. In some embodiments, after the first portions 860*a* have moved beyond the second projection 890 surface 890*b* may function to inhibit the second conduit 810 from moving from the second position back to the first position (i.e., such that the second conduit remains locked in the second position allowing venting of gases). After the first portions 860*a* have moved beyond the second projection 890, surface 890*b* may function to inhibit the second conduit 810 from moving from the second position back to the first position until the second conduit moves from the second position to at least the third position.

In some embodiments, a pouring spout assembly 110 may include one or more seals 1000 (e.g., as depicted in FIG. 49). A seal 1000*a* may be coupled to the proximal end of the third conduit 820 which inhibits, during use, liquids from being conveyed through the proximal end of the third conduit when the second conduit 810 is in the first position. A seal 1000*b* may be coupled to the proximal end of the fourth conduit 830 which inhibits, during use, gases from being conveyed through the proximal end of the fourth conduit when the second conduit 810 is in the first position. A seal 1000*c* may be coupled to the proximal end of the second conduit 810 which inhibits, during use, gases and/or liquids from being conveyed between the second conduit 810 and the first conduit 800. A seal (not depicted) may be coupled to the proximal end of the first conduit which inhibits, during use, liquids and gases from being conveyed around an exterior of the proximal end of the first conduit. Seals may be elastically deformable. Seals may be pliable. Seals may be formed from materials including such properties which are resistant to solvents and/or caustic fluids such as gasoline (e.g., rubber, silicone based polymers, etc.). Seals may be formed from a fluoroelastomer that gives good service in the gasoline environment. Fluoroelastomers may vary in fluorine content from about 66% to 70%. Materials which are desirable may include the best combination of functional sealing, mechanical hysteresis, and durability In some embodiments, a pouring spout assembly 110 may include a cap 430 (e.g., depicted in FIGS. 10-11). The cap 430 may function to couple the first conduit 800 to the container 100 (e.g., depicted in FIG. 1). When engaged to the container, the cap may inhibit movement of the first conduit relative to the container. The first conduit may be positionable in a cap opening 440 (e.g., depicted in FIGS. 10-11). The proximal end of the first conduit may be dimensioned such that the proximal end does not pass through the cap opening. In some embodiments, the cap may include a cap lock 450 which inhibits, during use, removal of the cap from the container. The cap lock may function to inhibit inadvertent removal of the cap and the spout assembly from the container. The cap lock may function in combination with portions of the container to inhibit removal. Caps may be interchangeable with pouring spout assemblies such that different types of caps may be used to work in combination with different containers including different locking mechanisms. In some embodiments cap locks may include cap locking mechanisms known to one skilled in the art.

In some embodiments, at least portions of the pouring spout assembly may be formed from materials including such properties which are resistant to solvents and/or caustic fluids such as gasoline (e.g., plastics, polymers, etc.). Portions of the pouring spout assembly may be formed from a rigid or semi rigid plastic such as polyolefins (Polyethylene, polypropylene, etc.), nylons, polyester, etc.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A pouring spout assembly for a container, comprising:

a first conduit;

a second conduit at least partially positionable, during use, in a distal end of the first conduit;

a third conduit positionable, during use, in a proximal end of the first conduit;

a fourth conduit coupled to the second conduit, wherein at least a portion of a distal end of the fourth conduit is positioned in the second conduit, wherein at least a portion of a proximal end of the fourth conduit is positionable, during use, in the third conduit;

wherein the second conduit moves, during use, from a first position to a second position, wherein when the second conduit is in the first position liquids are inhibited from being conveyed through a proximal end of the third conduit and gases are inhibited from being conveyed through the proximal end of the fourth conduit, and wherein when the second conduit is in the second position liquids are inhibited from being conveyed through the proximal end of the third conduit and gases are allowed to convey through the proximal end of the fourth conduit;

wherein the second conduit moves, during use, from the second position to a third position, wherein when the second conduit moves, during use, from the second position to the third position liquids are allowed to convey through the proximal end of the third conduit and gases are allowed to convey through the proximal end of the fourth conduit; and a spout lock which inhibits, during use, movement of the second conduit from the first position to the second position when the spout lock is engaged.

2. The assembly of claim 1, further comprising a handle coupled to the second conduit which conveys, during use, the second conduit from the first position to the second position and the third position when pressure is applied to the handle, wherein the second conduit is biased towards the first position;

wherein the spout lock comprises:

a first elongated member coupled to the first conduit, wherein when a first portion of the first elongated member engages, during use, a raised portion of a first projection coupled to the handle the spout lock is engaged;

wherein when sufficient pressure is applied to the first portion of the first elongated member the first portion disengages, moving to an unengaged position adjacent the exterior perimeter of the first projection, from the raised portion of the first projection unlocking the spout lock and allowing movement of the second conduit from the first position to at least the second position; and wherein after disengagement of the spout lock and as pressure is applied to the handle the first portion moves from the unengaged position around at least a portion of the exterior perimeter of the first projection until the handle is released and the first portion engages the raised portion locking the spout lock.

3. The assembly of claim 2, further comprising a first elastically deformable member positioned in the third conduit which applies, during use, a first force against the fourth conduit.

4. The assembly of claim 3, further comprising a second elastically deformable member positioned in the proximal end of the first conduit which applies, during use, a second force against the third conduit.

5. The assembly of claim 4, wherein the second force is greater than the first force.

6. The assembly of claim 3, further comprising a third elastically deformable member positioned in between the first conduit and the third conduit which applies, during use, a third force against the second conduit.

7. The assembly of claim 6, wherein the third force is greater than the second force.

8. The assembly of claim 1, wherein a proximal end of the third conduit comprises a reduced diameter relative to a distal end of the third conduit.

9. The assembly of claim 8, further comprising:

an elongated flexible conduit comprising a first end coupled to the proximal end of the third conduit; and a shaped floatable member coupled to a second end of the elongated flexible conduit which elevates, during use, an opening in the second end of the elongated flexible conduit above a liquid within the container.

10. The assembly of claim 1, wherein the handle is coupled to the second conduit through an elongated opening in the first conduit allowing the handle and the second conduit to move relative to the first conduit.

11. The assembly of claim 1, further comprising a seal coupled approximate to the proximal end of the third conduit which inhibits, during use, liquids from being conveyed through the proximal end of the third conduit when the second conduit is in the first position.

12. The assembly of claim 1, further comprising a seal coupled to the proximal end of the fourth conduit which inhibits, during use, gases from being conveyed through the proximal end of the fourth conduit when the second conduit is in the first position.

13. The assembly of claim 1, further comprising a seal coupled to the proximal end of the first conduit which inhibits, during use, liquids and gases from being conveyed around an exterior of the proximal end of the first conduit.

14. The assembly of claim 1, further comprising a seal coupled to the proximal end of the second conduit which inhibits, during use, liquids and gases from being conveyed around an exterior of the proximal end of the second conduit.

15. The assembly of claim 1, further comprising a cap configured to couple the first conduit to the container, wherein the first conduit is positionable in a cap opening, and wherein the proximal end of the first conduit is dimensioned such that the proximal end does not pass through the cap opening.

16. The assembly of claim 15, wherein the cap comprises a cap lock which inhibits, during use, removal of the cap from the container.

17. The assembly of claim 2, further comprising a second projection coupled to the handle, wherein after the second conduit moves from the first position to the second position the second projection inhibits movement of the second conduit from the second position to the first position.

18. The assembly of claim 2, further comprising a second projection coupled to the handle, wherein after the second conduit moves from the first position to the second position the second projection inhibits movement of the second conduit from the second position to the first position until the second conduit moves from the second position to the third position.

19. A method of pouring liquid through a spout assembly from a container, comprising:

inhibiting liquids from being conveyed through a proximal end of a third conduit when a second conduit is positioned in a first position in a first conduit, wherein the second conduit is positioned in a distal end of the first conduit and is functionally coupled to the third conduit positioned in a proximal end of the first conduit;

inhibiting gases from being conveyed through a proximal end of a fourth conduit when the second conduit is positioned in the first position, wherein at least a portion of a distal end of the fourth conduit is positioned in the second, and wherein at least a portion of a proximal end of the fourth conduit is positionable, during use, in the third conduit inhibiting movement of the second conduit from the first position to a second position using a spout lock when the spout lock is engaged, wherein the spout lock comprises:

a first elongated member coupled to the first conduit; and a first portion of the first elongated member, wherein when the first portion engages a raised portion of a first projection coupled to a handle the spout lock is engaged;

disengaging the spout lock of the spout assembly by applying sufficient pressure to the first portion of the first elongated member such that the first portion disengages, moving to an unengaged position on the exterior perimeter of the first projection, from the raised portion of the first projection unlocking the spout lock and allowing movement of the second conduit from the first position to at least the second position;

engaging the handle, coupled to the second conduit, and conveying the second conduit from the first position to the at least the second position, wherein the second conduit is biased towards the first position, and wherein engaging the handle moves the first projection from the unengaged position around at least a portion of the exterior perimeter of the first projection;

allowing gases to convey through a proximal end of the fourth conduit while inhibiting liquids from being conveyed through a proximal end of the third conduit;

engaging the handle and conveying the second conduit from the second position to a third position, wherein the second conduit is biased towards the second position;

allowing liquids to convey through a proximal end of the third conduit;

engaging the handle and conveying the second conduit from the third position to a fourth position, wherein the second conduit is biased towards the third position;

allowing liquids to convey through the proximal end of the third conduit at a rate of flow greater than when the second conduit is in the third position; and disengaging the handle such that the second conduit automatically conveys from the third position to the first position and the first portion automatically engages the raised portion of the first projection locking the spout lock.

20. A pouring spout assembly for a container, comprising:

a first conduit;

a second conduit positionable, during use, in a distal end of the first conduit;

a third conduit positionable, during use, in a proximal end of the first conduit;

a fourth conduit coupled to the second conduit, wherein at least a portion of a distal end of the fourth conduit is positioned in the second conduit, wherein at least a portion of a proximal end of the fourth conduit is positionable, during use, in the third conduit;

wherein the second conduit moves, during use, from a first position to a second position, wherein when the second conduit is in the first position liquids are inhibited from being conveyed through a proximal end of the third conduit and gases are inhibited from being conveyed through the proximal end of the fourth conduit, and wherein when the second conduit is in the second position liquids are inhibited from being conveyed through the proximal end of the third conduit and gases are allowed to convey through the proximal end of the fourth conduit;

wherein the second conduit moves, during use, from the second position to a third position, wherein when the second conduit moves, during use, from the second position to the third position liquids are allowed to convey through the proximal end of the third conduit and gases are allowed to convey through the proximal end of the fourth conduit; and a spout lock which inhibits, during use, movement of the second conduit from the first position to the second position when the spout lock is engaged.

* * * * *